US010810975B2

(12) United States Patent
Paige

(10) Patent No.: US 10,810,975 B2
(45) Date of Patent: Oct. 20, 2020

(54) CAPO FOR USE WITH A STRINGED MUSICAL INSTRUMENT, AND METHOD OF USING SAME

(71) Applicant: Bryan Paige, Jonesville, MI (US)

(72) Inventor: Bryan Paige, Jonesville, MI (US)

( * ) Notice: Subject to any disclaimer, the term of this patent is extended or adjusted under 35 U.S.C. 154(b) by 0 days.

(21) Appl. No.: 16/546,701

(22) Filed: Aug. 21, 2019

(65) Prior Publication Data

US 2020/0066238 A1 Feb. 27, 2020

Related U.S. Application Data

(60) Provisional application No. 62/720,169, filed on Aug. 21, 2018.

(51) Int. Cl.
*G10D 3/053* (2020.01)

(52) U.S. Cl.
CPC ..... *G10D 3/053* (2020.02)

(58) Field of Classification Search
CPC ..... G10D 3/053
See application file for complete search history.

(56) References Cited

U.S. PATENT DOCUMENTS 608,278 A 8/1898 Benson
656,904 A * 8/1900 Pletcher ..... G10D 3/053 84/318
775,399 A 11/1904 Halladay
1,007,960 A 11/1911 Moore
4,104,947 A 8/1978 Oster
D257,988 S * 1/1981 Nakamoto ..... 84/318
4,250,790 A 2/1981 Shubb et al.
D281,508 S * 11/1985 McKinney, III ..... 84/318
5,081,894 A * 1/1992 Paige ..... G10D 3/053 84/318
D446,540 S * 8/2001 Elliott ..... 84/318
6,528,711 B1 3/2003 Paige
7,973,227 B2 * 7/2011 Paige ..... G10D 3/053 84/318
9,786,257 B2 * 10/2017 Blacker ..... G10D 3/053
10,147,404 B2 * 12/2018 Campling ..... G10D 3/053
10,540,947 B2 * 1/2020 Blacker ..... G10D 3/053
2016/0247490 A1 * 8/2016 Campling ..... G10D 3/053

* cited by examiner

*Primary Examiner* — Robert W Horn
(74) *Attorney, Agent, or Firm* — Carrier Blackman & Associates, P.C.; William D. Blackman; Joseph P. Carrier

(57) ABSTRACT

A capo for a musical instrument includes a yoke having two opposed branches. A clamping bar, connected to one yoke branch, includes an engaging boss which fits into a machined notch of a second yoke branch, to releasably lock the clamping bar therein. The clamping bar pivots around a retaining shaft, and is also slidably movable by a length of a slot formed therein. A saddle member has a central stem, a seat attached to the stem, and an adjustment member for tightening the saddle member on the yoke. A resilient, tubular biasing member surrounds a main body of the clamping bar. Pressing a free end of the clamping bar compresses the biasing member, and slides the engaging portion of the clamping bar out of the machined notch of the yoke, to allow pivotal movement of the clamping bar and removal of the capo from the musical instrument.

9 Claims, 20 Drawing Sheets

CAPO FOR USE WITH A STRINGED MUSICAL INSTRUMENT, AND METHOD OF USING SAME

CROSS-REFERENCE TO RELATED APPLICATIONS

This application claims priority to U.S. Provisional patent application No. 62/720,169, filed on Aug. 21, 2018. The entire subject matter of these priority documents, including specification claims and drawings thereof, is incorporated by reference herein.

BACKGROUND OF THE INVENTION

1. Field of the Invention

The present invention relates to a capo for use with a stringed musical instrument to effectively change the key in which the instrument is playing, and to a method of using the capo. More particularly, the present invention relates to a capo having a yoke and a clamping bar with a resilient, tubular biasing member which surrounds a main body of the clamping bar. Pressing a free end of the clamping bar compresses the biasing member, and slides an engaging portion of the clamping bar out of a machined notch of the yoke, to allow pivotal movement of the clamping bar and installation of the capo on, or removal of the capo from the musical instrument.

2. Description of the Background Art

A number of different capos are known for use with stringed musical instruments, particularly guitars, like, which have a neck including a fretboard on which the strings are played. The capo is a clamping device which fits on the instrument neck and is used to selectively clamp upon the strings of the fretboard in order to alter the effective length of vibration of the strings.

The capo allows for selective alteration of the tonality of the strings without affecting the original tuning of the instrument. Thus, by placing the capo at a pre-selected location on the fretboard, a musician can play his or her instrument and produce a desired sound quality, since the pitch produced by the strings with the capo attached is different from the pitch produced by the stings with the capo absent. This allows a musician to temporarily change the key in which the instrument is playing.

A number of different capos are known and commercially available. Each of these is basically a clamping type of device in which a padded bar is caused to press transversely across the strings by operation of an adjustable clamping mechanism that interacts with the underside of the fretboard.

U.S. Pat. No. 608,278 to Benson, dated Aug. 2, 1898, discloses a capo having a generally U-shaped main body, a bar connected to the upper portion of the main body for transversely contacting the fretboard strings, a foot for pressing against the underside of the fretboard, a screw operated clamping mechanism and a guide finger interconnected with the foot and the lower portion of the main body for keeping the foot from turning when the screw of the screw operated clamping mechanism is rotated to effect clamping of the bar onto the strings.

U.S. Pat. No. 656,904 to Pletcher, dated Aug. 28, 1900, discloses a capo having a bar for pressing transversely against the strings, a clasp member pivotally connected to the bar, an arm member connected to one end of the bar, and a spring steel clip pivotally connected with the arm and which is structured to selectively engage the clasp member.

U.S. Pat. No. 775,399 to Halladay, dated Nov. 22, 1904, discloses a capo having a bar for transversely engaging the strings, an arm connected to the bar, and a screw actuated lever clamp pivotally interconnected with the arm.

U.S. Pat. No. 1,007,960 to Moore, dated Nov. 7, 1911, discloses a capo having a bar for transversely contacting the strings, a rod pivotally connected at either side of the bar, and a screw operated foot pivotally connected to the free ends of the rods.

U.S. Pat. No. 4,104,947 to Oster, dated Aug. 8, 1978, discloses a capo having a U-shaped member of which the upper portion thereof serves as a bar for transversely engaging the strings, two off-set resilient string engaging members, a screw operated clamping mechanism connected with the lower portion of the U-shaped member and a foot interconnected with the clamping mechanism and a central portion of the U-shaped member.

U.S. Pat. No. 4,250,790 to Shubb et al, dated Feb. 17, 1981, discloses a capo having a bar with a resilient material for transversely contacting the strings, an arm connected to the bar, a curved jaw pivotally connected to the arm for contacting the underside of the fretboard, a lever pivotally connected to the arm in spaced relation with respect to the curved jaw, and a screw mechanism interconnected with the lever.

U.S. Design Pat. No. D257,988 to Nakamoto, dated Jan. 20, 1981, discloses an ornamental design for a capo showing a yoke having a pivotally connected bar for transversely contacting the strings, a releasable clasp mechanism for holding the bar in fixed relation to the yoke, and a screw operated clamp mechanism which includes a foot for contacting the underside of the fretboard and guide rods for preventing the foot from rotating when the screw is rotated.

U.S. Design Pat. No. D281,508 to McKinney, Ill., dated Nov. 26, 1988, discloses an ornamental design for a capo showing a yoke having a pivotally connected bar for transversely contacting the strings, a releasable clasp mechanism for holding the bar in fixed relation to the yoke, and a screw operated clamp mechanism which includes a foot for contacting the underside of the fretboard and a guide member for preventing the foot from rotating when the screw is rotated.

U.S. Design Pat. D446,540 issued Aug. 14, 2001 to Elliott discloses another ornamental capo design.

U.S. Pat. No. 5,081,894 to Paige, issued Jan. 21, 1992, discloses a capo including a semi-circular yoke, a bar pivotally connected to a first fork of the yoke and releasably interlocked at the second end to a second fork of the yoke via intermeshing of opposing slots, a clasp mechanism for releasably locking onto an end of the bar, a screw-operated foot connected with the yoke, and dual guide bars connected at either side of the foot which movably engage slots in the yoke. The capo of this reference engages the strings uniformly and simultaneously as the screw is tightened.

The present applicant has also patented some earlier capo designs in U.S. Pat. Nos. 5,081,894, 6,528,711, and 7,973,227.

While the foregoing examples of capos are usable for their intended purposes, a need still exists in the art for an improved capo. In particular, there is a need for an improved capo, and method of installing same, which is capable of being installed and adjusted quickly, and which has a simplified structure and a limited number of moving parts.

For a more complete understanding of the present invention, the reader is referred to the following detailed description section, which should be read in conjunction with the accompanying drawings. Throughout the following detailed description and in the drawings, like numbers refer to like parts.

SUMMARY OF THE INVENTION

The present invention provides a capo for use with a stringed musical instrument having a neck including a fretboard, and a plurality of strings extending parallel to one another above the fretboard.

A capo according to a first illustrative embodiment hereof includes a substantially U-shaped yoke having a yoke body with a center section having a central through bore formed therein and defining a first axis, the yoke body having a first yoke branch extending outwardly on one side of the center section and a second yoke branch extending outwardly on the other side of the center section.

The first yoke branch terminates at a first branch end having a bar-receiving slot formed therein, and the second yoke branch terminates at a free branch end having a machined notch formed therein configured to temporarily receive one end of a clamping bar.

The capo according to the first illustrative embodiment further includes a clamping bar having a first bar end and a second bar end, the first bar end of the clamping bar ends in a tip portion with a plate shape having rounded corners and configured to fit in the bar-receiving slot of the first yoke branch. The tip portion of the first bar end also has a longitudinal slot formed therein. The first bar end of the clamping bar is pivotally attached to the first branch end of the yoke.

The second bar end of the clamping bar includes a manually pressable end portion and an engaging portion close to the end portion, the engaging portion being selectively operatively engagable with the machined notch of the second yoke branch, for temporarily and releasably locking the clamping bar into engagement with the yoke.

The capo according to the first illustrative embodiment further includes a tubular biasing member, formed of flexibly resilient material and surrounding a main body portion of the clamping bar between the two ends thereof;

The capo according to the first illustrative embodiment further includes a retaining shaft operatively attached to the first branch end of the first yoke branch, the retaining shaft extending through the longitudinal slot of the tip portion at the first bar end of the clamping bar. The retaining shaft may be provided as a shaft portion of a fastener.

Due to the structure described above, the clamping bar of the capo according to the first illustrative embodiment is selectively pivotally movable around the retaining shaft, in relation to the first end of the yoke, and the clamping bar is also slidably movable by a distance corresponding to the length of the slot formed in the tip portion of the clamping bar.

The capo according to the first illustrative embodiment further includes a saddle member including a central stem having a proximal end and a distal end, and the central stem extends through the central through bore of the yoke body and has male threads formed thereon.

The saddle member also includes a seat portion, which is attached to the proximal end of the stem for placement contacting a portion a rear side of the neck of a musical instrument; and the saddle member also includes an adjustment member, operatively associated with the central stem, for selectively adjusting a position of the saddle member in relation to the yoke.

Optionally, the adjustment member may further include a thumbscrew integrally attached to the distal end of the central stem for selectively causing rotation thereof.

The capo according to the first illustrative embodiment is configured such that manually pressing on the terminal portion of the clamping bar compresses the biasing member, and slidably moves the engaging portion of the clamping bar out of engagement with the machined notch of the yoke, permitting a user to pivotally move the second end of the clamping bar away from the free branch end of the yoke, in order to permit installation, removal or adjustment of a position of the capo in relation to the neck of a musical instrument.

A capo according to a second illustrative embodiment of the invention includes identical features to those of the first embodiment, except as specified herein as being different.

The capo according to the second embodiment includes a yoke body having a core portion, a first branch extending outwardly on a first side of the core portion, and a second branch extending outwardly on a second side of the core portion, the core portion having a central through bore formed therethrough and defining a first axis, the central through bore having a non-circular cross section including a plurality of lobes. The cross-section of the through bore may be X-shaped, as shown.

Also in the capo according to the second embodiment, the core portion further has a passage formed therethrough in a direction substantially perpendicular to the first axis, the passage having a substantially rectangular cross-sectional shape.

In the capo according to the second embodiment, the first and second yoke branches are configured substantially as described herein in connection with the first embodiment.

The capo according to the second embodiment also includes a saddle member comprising a central stem having a proximal end and a distal end, the central stem having a non-circular cross-section with a plurality of lobes, with outer ends of the lobes having male thread portions formed thereon, and a seat portion attached to the proximal end of the stem for placement contacting a portion of the neck opposite the fretboard, wherein the seat portion is rotatably attached to the proximal end of central stem.

The capo according to the second embodiment further includes a knurled nut housed in the passage of the yoke body, the nut having a cylindrical outer shape, surrounding a portion of the central stem of the saddle member and provided for selectively adjusting a position of the saddle member relative to the yoke.

The capo according to the second embodiment also includes a a clamping bar configured substantially as described above in connection with the first embodiment, including a tubular biasing member formed of flexibly resilient material and surrounding a main body portion of the clamping bar between the two ends thereof.

During use of the capo according to the second embodiment, manually pressing on the terminal portion of the clamping bar slidably moves the engaging portion of the clamping bar out of engagement with the machined notch of the yoke and compresses the biasing member, permitting a user to pivotally move the clamping bar away from the free branch end of the yoke. This feature is common to both the first and second embodiments.

A third embodiment of the invention is also contemplated. The third embodiment hereof is identical to the second embodiment, except as expressly specified herein as being different.

In the capo according to this third embodiment, a control module is attached to the yoke. The control module includes a touch screen with visual display, a power switch, a motor, and a microprocessor in electronic communication with the motor and also with a pressure sensor situated on the clamping bar.

The capo according to the third embodiment also includes a cylindrical adjustment nut having external teeth thereon. The cylindrical adjustment nut also functions as a ring gear which can be driven by the motor via a worm gear.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
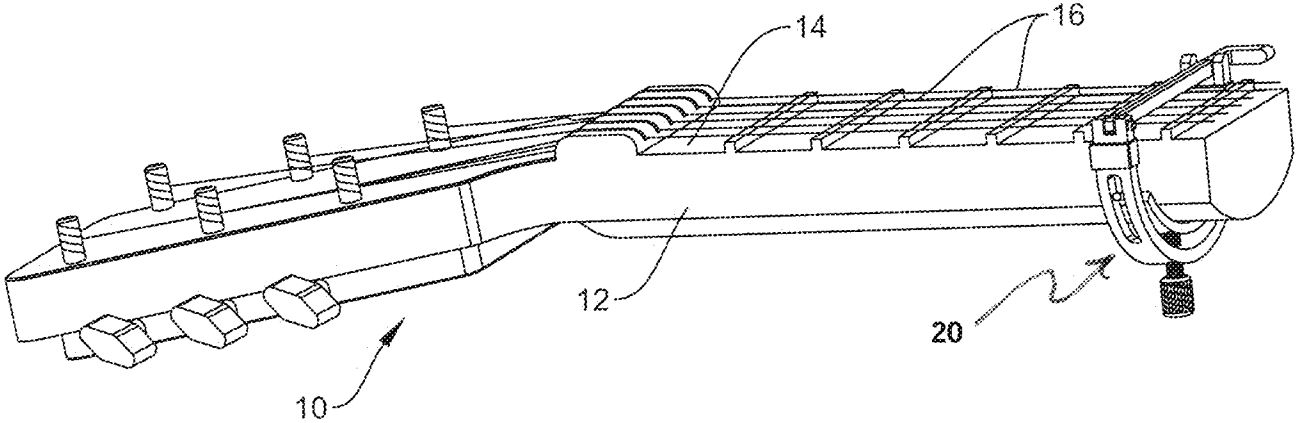
FIG. 1 is an environmental perspective view of a guitar neck having a capo installed thereon according to a first illustrative embodiment of the present invention.

Descriptions will be provided below of selected illustrative embodiments of the present invention as examples of the present invention, supported by and shown in the accompanying drawings. It should be understood that only structures considered necessary for clarifying the present invention are described herein. Other conventional structures, and those of ancillary and auxiliary components of the system, will be known and understood by those skilled in the art.

Throughout the present specification, relative positional terms like 'upper', 'lower', 'front', 'rear', 'top', 'bottom', 'horizontal', 'vertical', and the like are used to refer to the orientation of the capo apparatus as shown in the drawings. These terms are used in an illustrative sense to describe the depicted embodiments, and are not meant to be limitative. It will be understood that the depicted apparatus may be placed at an orientation different from that shown in the drawings, such as inverted 180 degrees or transverse to that shown, and in such a case, the above-identified relative positional terms will no longer be accurate.

While the drawings and description herein describe the capo as used with a stringed musical instrument such as a guitar, the stringed instrument does not form part of the invention, per se, but rather, the stringed instrument is used as a workpiece on which the capo hereof is applied.

First Embodiment

FIGS. 1-8 of the drawings illustrate a capo 20 according to a first illustrative embodiment of the present invention. In FIG. 1, the capo 20 is shown in operation compressing strings 16 on a fretboard 14 situated on a rear side of a neck 12 of a stringed instrument 10. The capo 20 is shown in a closed configuration in FIGS. 1 and 2, and is shown in an open configuration in FIG. 5.

The capo 20 includes a yoke 22, including a central section 23 and first and second branch portions 26, 28 integrally attached to, and extending outwardly from the central section 23 in opposite directions. The central section 23 of the yoke 22 has a central through bore 21 formed therein, which receives a threaded shaft portion 71 of an adjustment member 70, to be described later. In the capo 20 according to the first illustrative embodiment hereof, the central through bore 21 has female threads formed therein.

The yoke 22 may be constructed of stainless steel, other metal, or a high-strength plastic, and is dimensioned to generally fit about the rear surface of a neck portion 12 of a standard stringed musical instrument 10, as shown in FIG. 1.

The yoke 22 is provided with a generally semi-circular curvilinear arcuate U-shape, which is modified to have locally linear segments at each of respective outer end portions 26*a* and 28*a* (FIG. 5) of the yoke branch portions 26 and 28, respectively.

Figure 3:
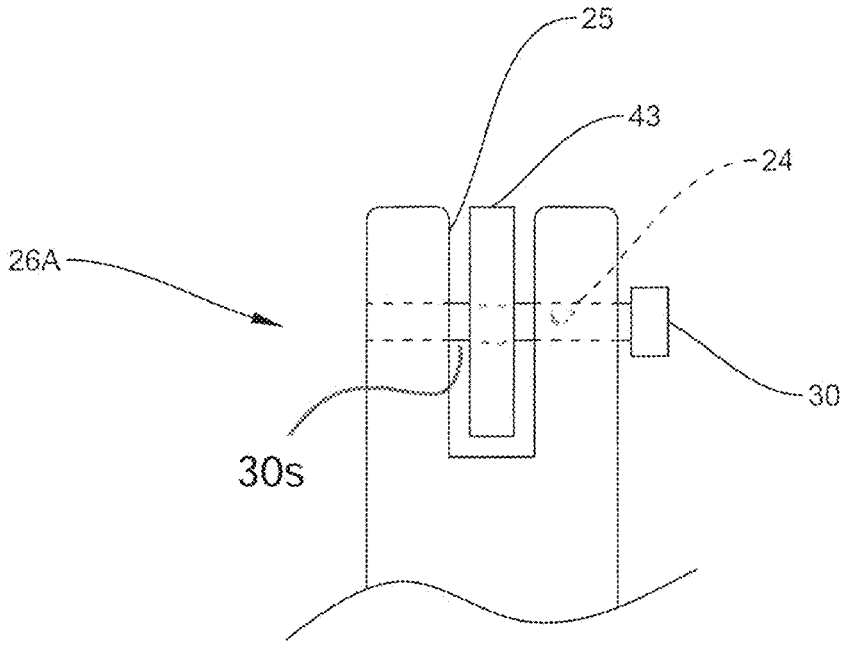
FIG. 3 is a detail side plan view of a first end of a yoke portion of the capo of FIG. 2.
Figure 4:
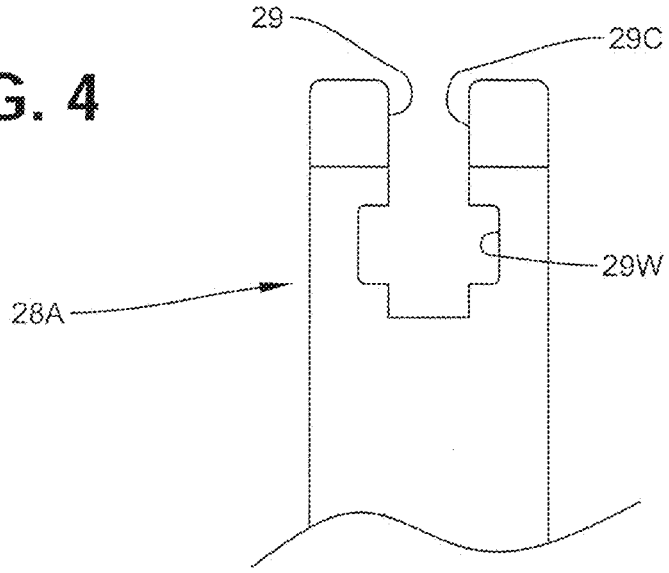
FIG. 4 is a detail side plan view of a second end of the yoke portion of the capo of FIG. 2.
Figure 5:
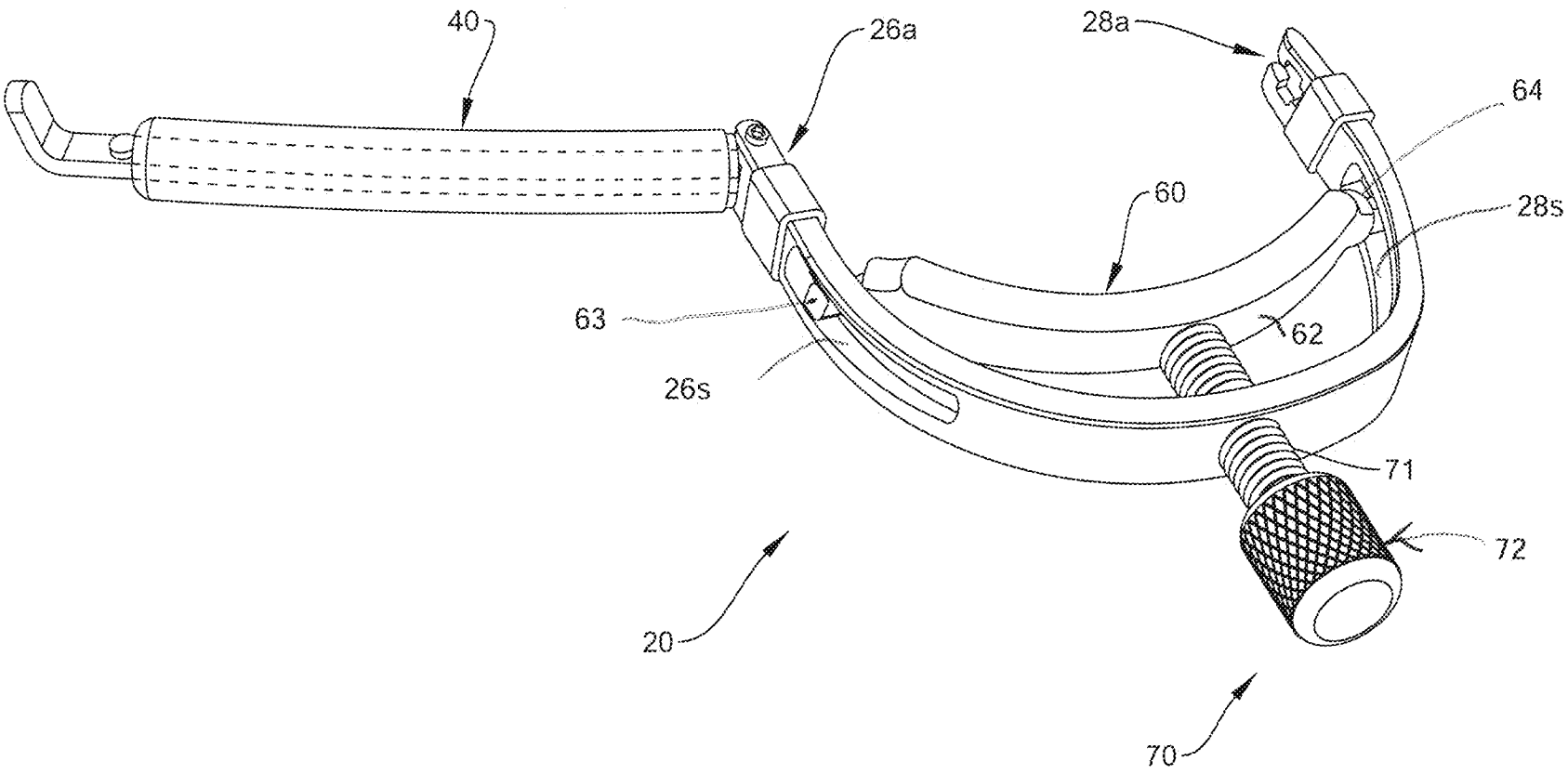
FIG. 5 is a perspective view of the capo of FIGS. 1-4, shown in an open configuration.

Referring additionally to FIGS. 3 through 5, the first branch portion 26 of the yoke 22 terminates at a first branch end 26A, having a clamping bar 40 pivotally attached thereto. The first branch end 26A has a hollow bore 24 formed therein for receiving a fastener 30, which may be a threaded fastener, a rivet, or another component. In addition, the first branch end 26A also has a bar-receiving slot 25 formed therein which extends substantially perpendicular to, and which intersects the hollow bore 24 thereof. The bar-receiving slot 25 receives a tip portion 43 of the clamping bar 40 therein, and the fastener 30 pivotally attaches the clamping bar to the first branch end 26A of the yoke 22, as shown.

The second branch portion 28 of the yoke 22 terminates at a free branch end 28*a* having a machined notch 29 formed therein, configured to selectively and temporarily receive a free end portion (second end 44) of the clamping bar 40 therein.

The machined notch 29 includes an upper portion 29*c* having a first width, and a widened portion 29*w*, which is wider than the upper portion.

Referring back to FIG. 2 and also to FIG. 5, the capo 20 also includes a substantially Y-shaped saddle member 60, including a bow-shaped seat 62 and an adjustment member 70. The seat 62 of the saddle member is provided for placement contacting a rear portion of a musical instrument's neck 12, opposite the fretboard 14 (See FIG. 1), and for applying a clamping pressure to tighten the clamping bar 40 against the fretboard.

The adjustment member 70 is rotatably connected to a central portion of the seat 62, and also to the central section 23 of the yoke 22 as previously discussed. In this first illustrative embodiment, the seat 62 includes outer end portions 63, 64, which fit slidably into opposed guide slots 26*s*, 28*s* (FIGS. 5, 8) respectively formed in the first and second branches 26, 28 of the yoke 22.

The adjustment member 70 includes a thumbscrew 72 which may have a knurled knob, as shown, to facilitate grasping thereof by a user. The adjustment member 70 also includes a threaded central stem 71, with a proximal end and a distal end which is integrally attached to the thumbscrew. (The proximal end is given that name because it is located closer to the guitar neck during use.) The central stem 71 of the adjustment member 70 has male threads formed thereon which are threadably engaged in the threaded central through bore 21 of the yoke 22.

The proximal end of the adjustment member's central stem 71 is operatively connected to the seat 62 in a manner so as to allow free rotation of the adjustment member 70 in relation to the seat. Rotation of the adjustment member 70 causes the seat 62 to selectively move toward or away from the clamping bar 40, which is particularly useful when the capo is in the closed configuration shown in FIG. 2, and is being installed on a musical instrument 10 such as shown in FIG. 1.

The proximal end of the central stem is rotatably attached to a central portion of the seat 62, to permit axial adjustment of the seat along a central axis of the stem, which is aligned with an axis of symmetry of the yoke.

As previously noted, the capo 20 also includes the pivotally movable and padded clamping bar 40, which is pivotally connected to the first branch portion 26 of the yoke 22 via the fastener 30. The clamping bar 40 has a first end 42 and a free, or second end 44.

Figure 8:
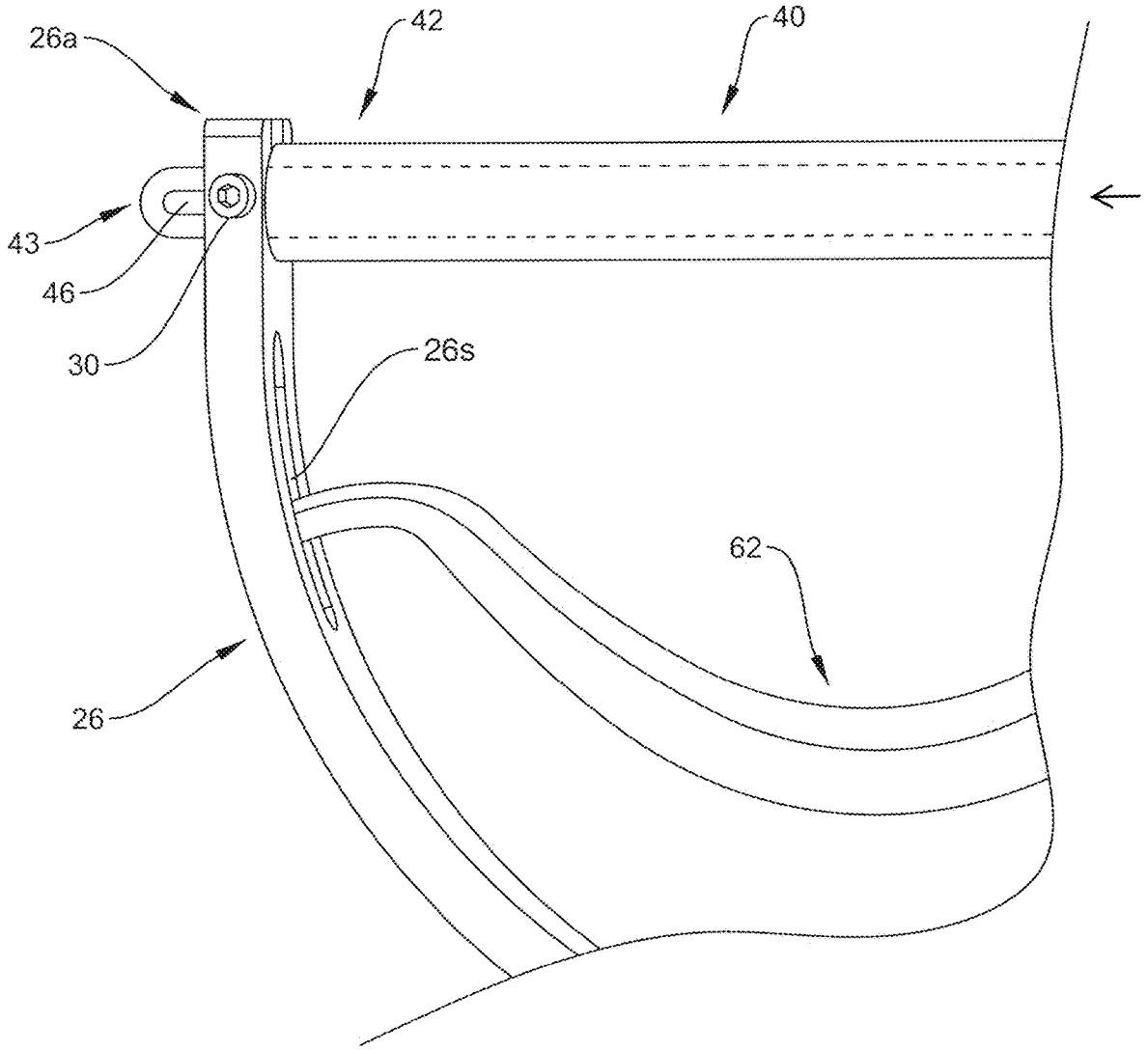
FIG. 8 is a detail perspective view of part of the capo of FIG. 2, with selected parts omitted for illustrative purposes, and showing another, tip end of the clamping bar in a compressed configuration, during application of pressure to the opposite end of the clamping bar.

As seen in FIGS. 3 and 8, the first end 42 of the clamping bar 40 ends in a tip portion 43 with a plate shape, configured to fit in the bar-receiving slot 25 of the first branch portion. As seen best in FIG. 8, the tip portion 43 of the clamping bar 40 has a longitudinal slot 46 formed therein which receives a shaft portion 30*s* (FIG. 3) of the fastener 30 therethrough, and in this way, the clamping bar 40 is pivotally attached to the first branch end 26*a* of the yoke 22.

The fastener 30 may be a rivet, a threaded fastener or other retainer. The fastener 30 includes the cylindrical shaft portion 30*s*, which is inserted through the longitudinal slot 46 of the tip portion 43 at the first end of the clamping bar 40, in a manner such that the clamping bar is selectively slidably movable on, and is also pivotally movable around the shaft portion of the fastener. The fastener 30 may also be referred to as a retainer.

As can be seen from reference to FIG. 1, when the capo 20 is installed on an instrument 10, the clamping bar 40 thereof is structured to extend transversely across the strings 16 of the fretboard 14. By applying force onto the strings, the strings are forced against the fretboard 14, thereby effectively changing the vibration length of the strings 16. The compressive force of the clamping bar 40 pressing onto the strings 16 is reinforced by the seat 62 of the saddle member 60 being clamped against the back of the neck portion 12 through operation of the adjustment member 70, which is adjustable to cause the saddle member 60 to slide with respect to the yoke 22, until the clamping bar 40 applies a desired compressive force to the strings.

Figure 2:
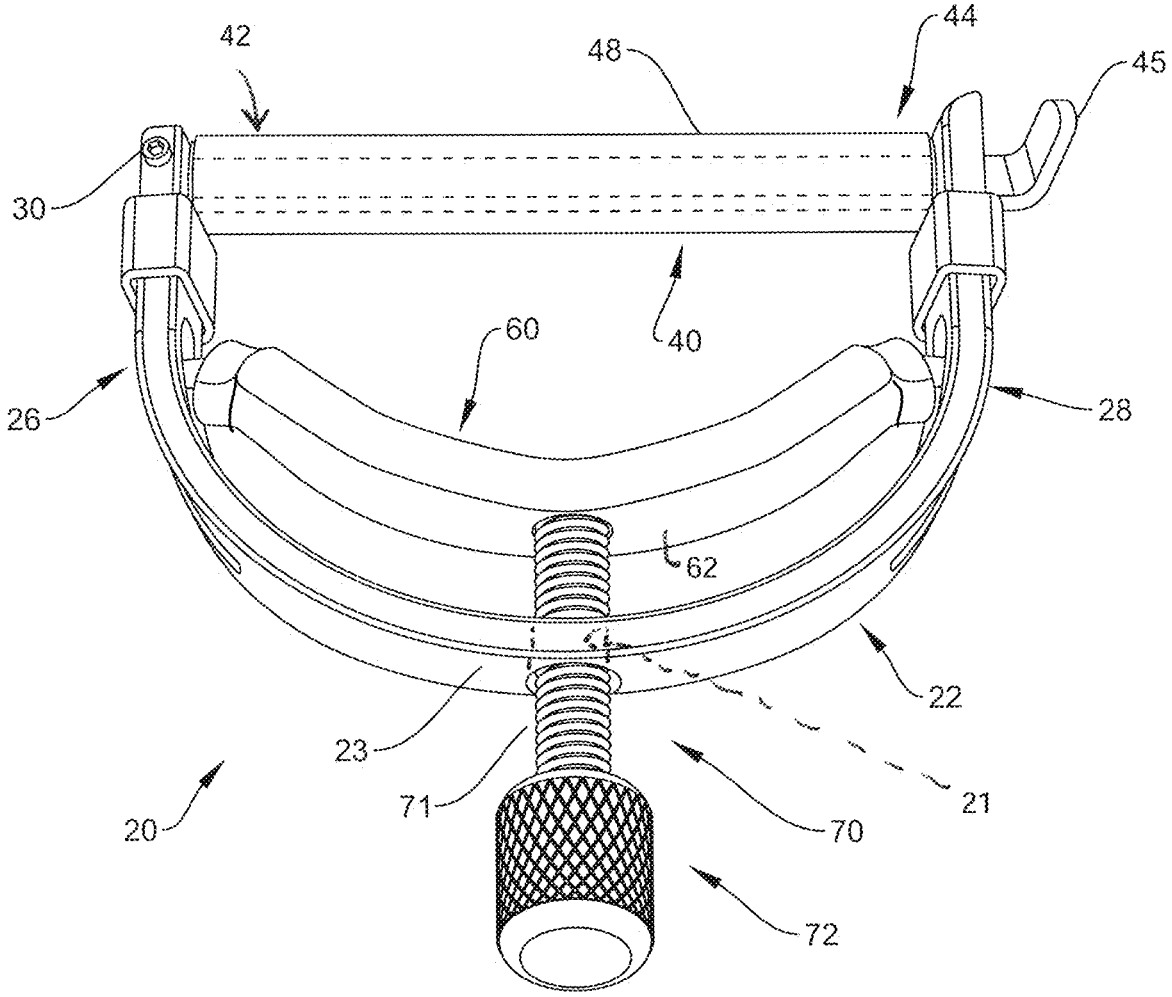
FIG. 2 is a perspective view of the capo of FIG. 1, shown in a closed and latched configuration.
Figure 7:
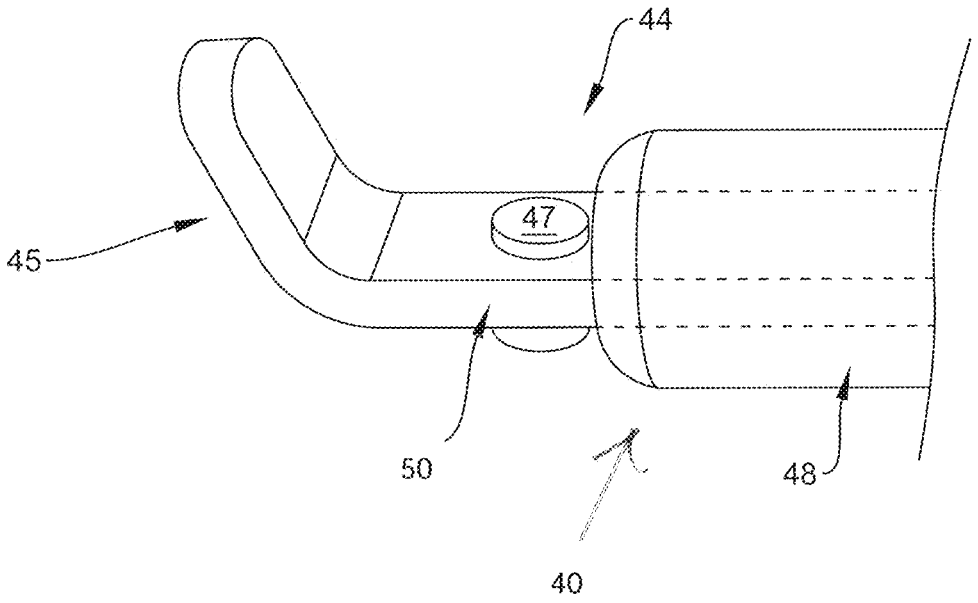
FIG. 7 is a detail perspective view of one end of a clamping bar, which is a component part of the capo of FIGS. 1-5.

As seen in FIGS. 2 and 7, the second end 44 of the clamping bar 40 includes a manually pres sable terminal portion 45, and an engaging portion 50 proximate the terminal portion, the engaging portion being selectively operatively engagable with the machined notch 29 formed in the free branch end 28*a* of the yoke's second branch portion 28, for temporarily and releasably locking the second end 44 of the clamping bar 40 into engagement with the free branch end 28*a* of the yoke 22. In the depicted embodiment, the engaging portion 50 includes two integral cylindrical bosses 47, extending outwardly on the clamping bar as shown. These bosses 47 are configured to, selectively and temporarily, fit engagingly into the widened portion 29*w* of the machined notch 29 formed in the free branch end 28*a* of the yoke 22, to temporarily lock the clamping bar into its closed position.

The capo according to the first illustrative example hereof further includes a tubular biasing member 48, formed of flexibly resilient material such as flexible plastic, rubber, or a suitable elastomer. The tubular biasing member 48 may be transparent or opaque, as desired. This tubular biasing member 48 surrounds a main body portion of the clamping bar 40, between the two ends 42, 44 thereof, and is provided for placement betweeen the first and second ends of the yoke 22 as shown in FIG. 2.

In addition, the clamping bar 40 is slidably movable inwardly in relation to the yoke 22, in a direction parallel to a longitudinal axis thereof, by a short distance corresponding to the length of the slot 46 formed in the tip portion 43 of the clamping bar. This longitudinal movement is effected by manual pressure applied to the terminal portion 45 of the clamping bar 40, to move the clamping bar in a direction indicated by the arrow shown on the far right hand side in FIG. 8.

During engagement or disengagement of the clamping bar 40 with the yoke 22, manually pressing on the terminal portion 45 of the clamping bar moves the slotted tip end 43 of the clamping bar outwardly past the fastener 30, to an extended position shown in FIG. 8. This movement of the clamping bar 40 also slidably moves the engaging portion 50 of the clamping bar out of engagement with the machined notch 29 of the yoke. At the same time, such manual pressure on the terminal portion of the clamping bar compresses the tubular biasing member 48, permitting a user to then pivotally move the second end 44 of the clamping bar away from the free branch end 28*a* of the yoke 22.

A similar process to that described above may be used in reverse to engage the engaging portion 50 of the clamping bar 40 in the machined notch 29 of the yoke 22. When manual pressure on the terminal end 45 of the clamping bar 40 is released, the resilient nature of the tubular biasing member 48 moves the bosses 47 on the engaging portion 50 into the widened portion 29*w* of the yoke's machined notch 29, thereby temporarily locking the position of the clamping bar 40 in relation to the yoke 22.

Second Embodiment

A capo according to a second illustrative embodiment of the present invention is shown generally at 220 in FIGS. 9A-12. This capo 220 is similar in some aspects to the capo 20 shown in FIGS. 1-2, and is different in other aspects, as will be described herein. In the following description, it should be kept in mind that the capo according to a second illustrative embodiment of the invention includes identical features to those of the first embodiment as previously described, except for those features specified herein as being different.

Figure 12:
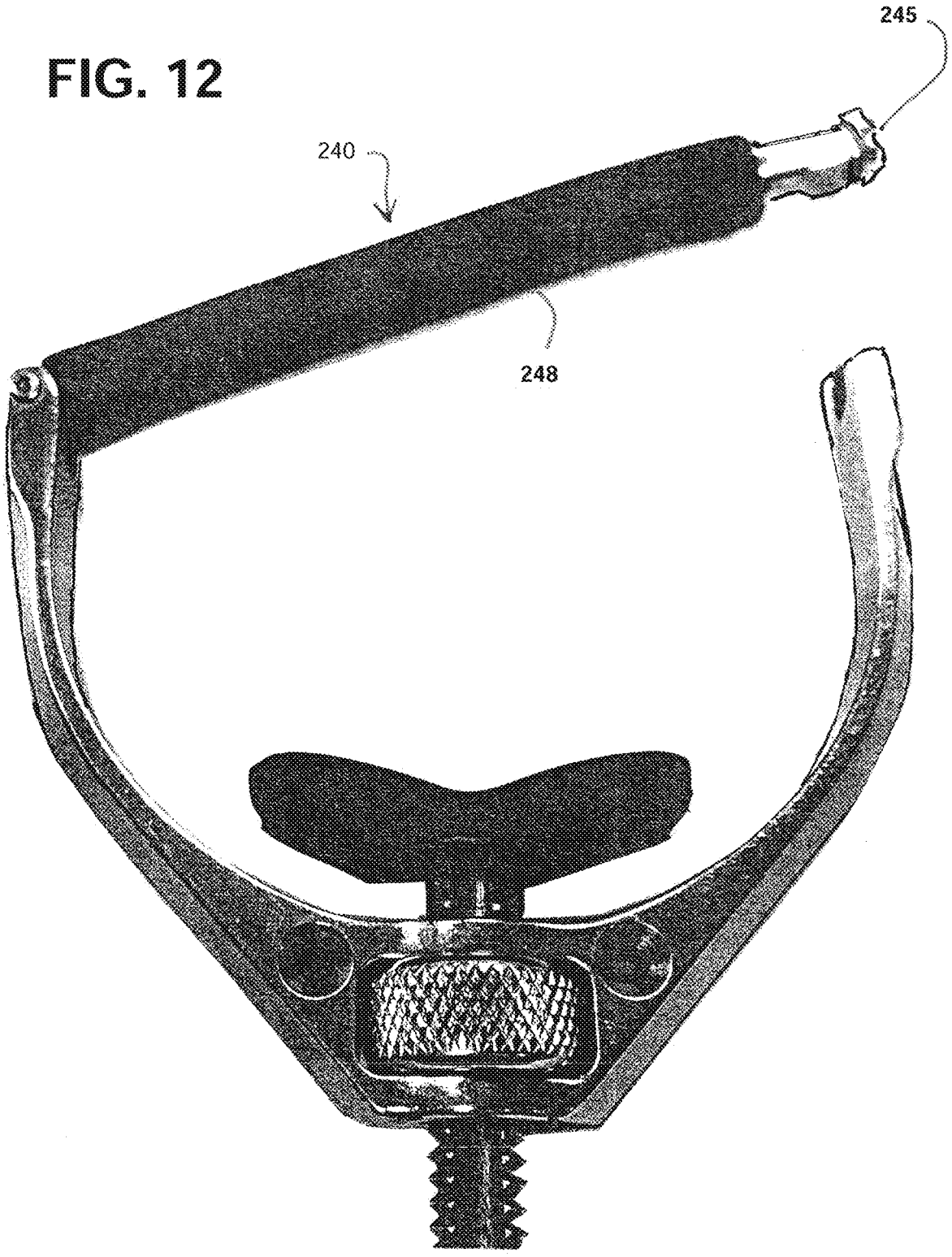
FIG. 12 is a front plan view of the capo of FIG. 9A, shown in an open configuration.

The capo 220 is shown in a closed configuration in FIGS. 9A-11, and is shown in an open configuration in FIG. 12.

Figure 13:
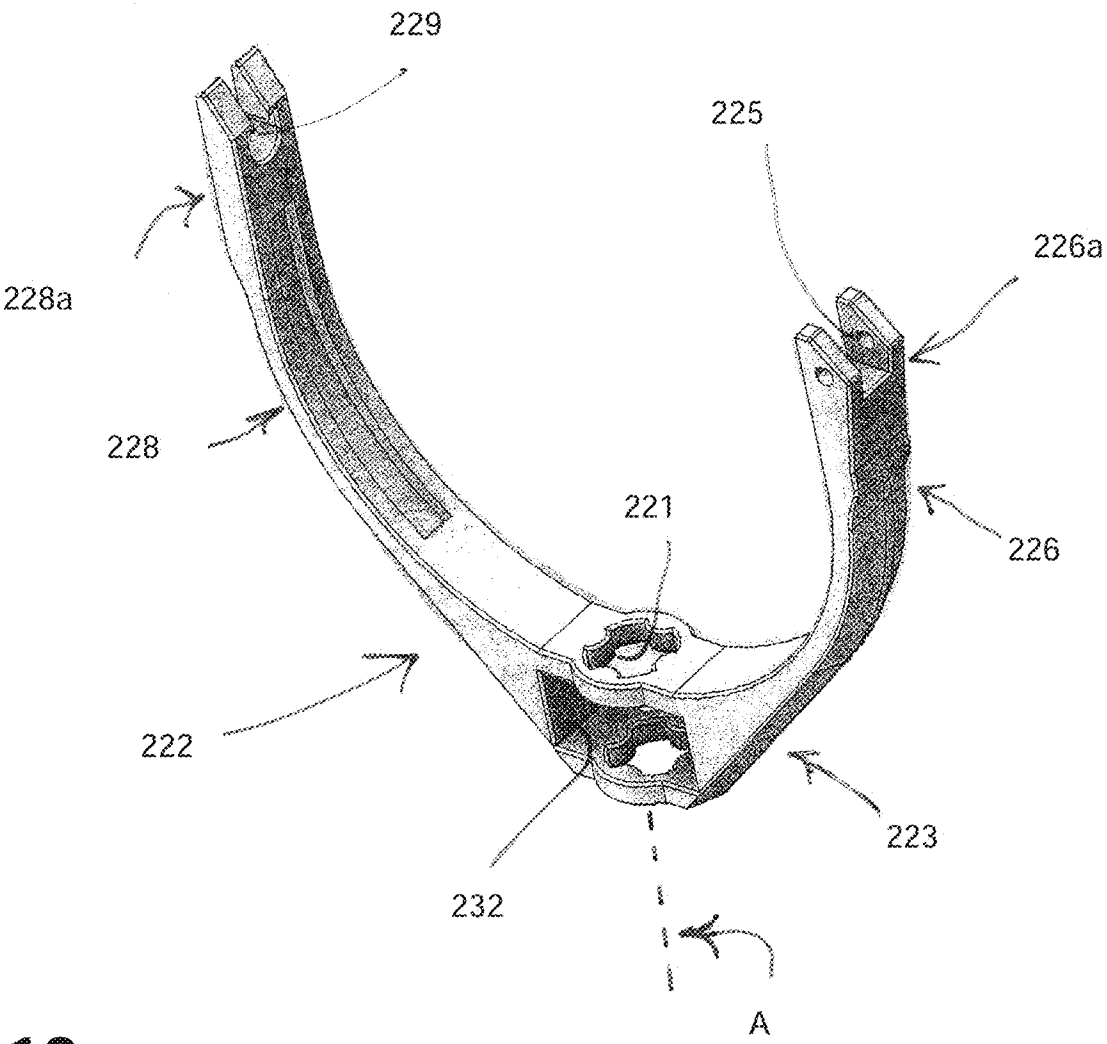
FIG. 13 is a perspective view of a yoke which is a component part of the capo according to the second embodiment hereof.

The capo 220 includes a yoke 222, which is shown separately in FIG. 13. The yoke 222 includes a central section 223 and first and second branch portions 226, 228 integrally attached to, and extending outwardly from the central section 223 in opposite directions. As seen in FIG. 13, the central section 223 of the yoke 222 has a central through bore 221 formed therein, which extends along a central axis of symmetry A of the yoke. In the embodiment depicted in FIG. 13, the central through bore 221 has a non-circular cross-sectional shape substantially resembling a modified cross with four outwardly extending lobes, as shown.

In a different, modified embodiment, a different number of lobes could be used instead of four, such as, for example, any number from two to six.

The central through bore 221 is configured to slidably receive a threaded shaft portion 261 of a saddle member 260 (FIG. 14) having a cross-sectional shape corresponding to the shape of the through bore, in order to prevent rotary movement of the saddle member 260 in relation to the yoke 222. In this capo 220 according to the second illustrative embodiment, the central through bore 221 of the yoke 222 has smooth internal walls without any threads formed therein.

As may also be seen in FIG. 13, the central section 223 of the yoke 222 has a hollow rectangular passage 232 formed therethrough, in a direction which is perpendicular to the central axis of symmetry A of the through bore 221. The central through bore 221 intersects, and communicates with the rectangular passage 232. The rectangular passage is provided to receive and house a cylindrical adjustment nut 270 therein, as will be further described below.

The yoke 222 may be constructed of stainless steel, other metal, or a high-strength plastic, and is dimensioned to generally fit about the neck portion of a standard stringed musical instrument such as a guitar, as shown in FIG. 1. The yoke 222 is provided with a generally semi-circular curvilinear arcuate U-shape, which is modified to have locally linear segments at each of respective outer end portions 226*a* and 228*a* of the yoke branch sections 226 and 228, respectively.

The first branch portion 226 of the yoke 222 terminates at the first branch end 226*a*, which is substantially identical to the first branch end 26*a* shown in FIG. 3 and described above in connection with the first embodiment.

Figure 6:
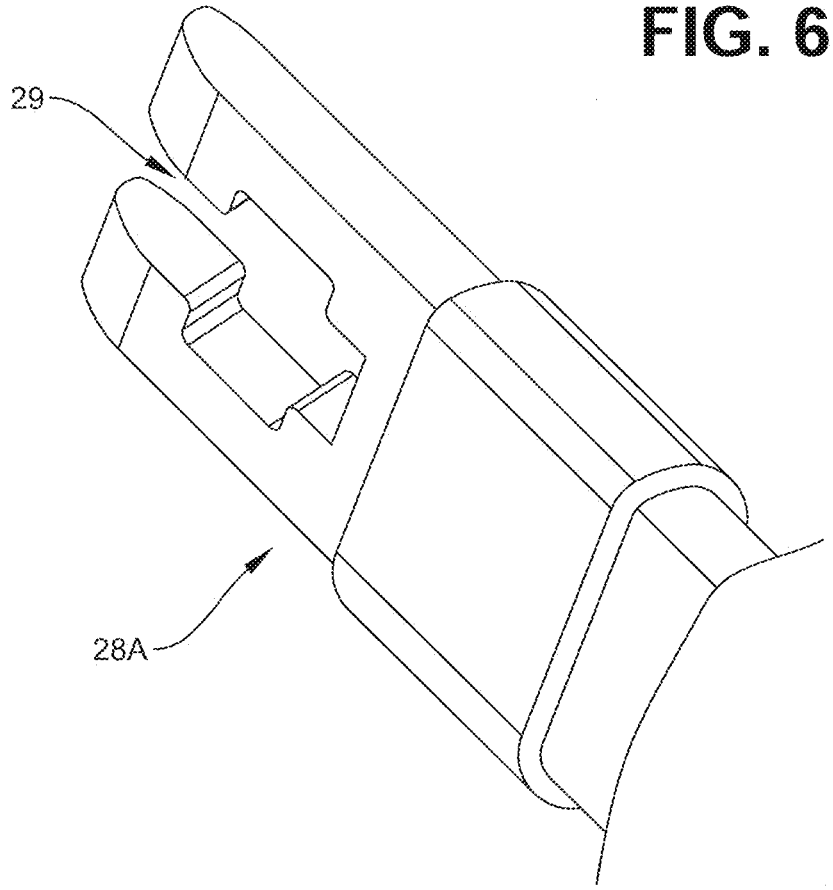
FIG. 6 is a detail perspective view of the second end portion of the yoke of the capo of FIGS. 1-5.

The second branch portion 228 of the yoke 222 terminates at a free branch end 228*a* having a machined notch 229 formed therein and configured in a manner substantially similar to that shown in FIGS. 4 and 6 and described above in connection with the machined notch 29 of the first embodiment.

Figure 14:
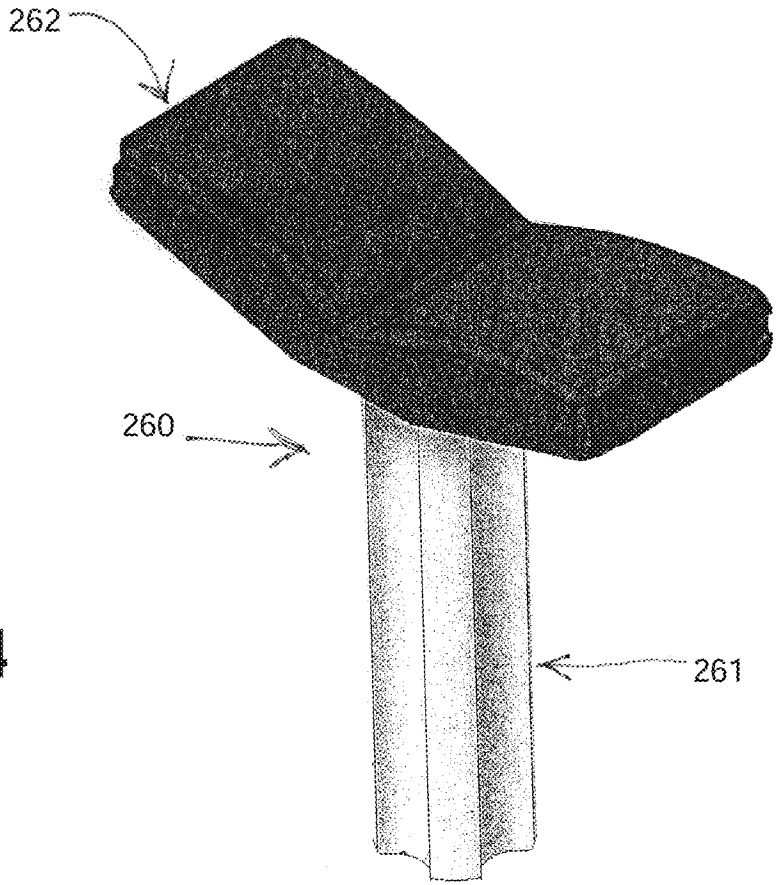
FIG. 14 is a perspective view of a saddle member which is another component part of the capo according to the second embodiment hereof.

The capo 220 also includes a substantially Y-shaped saddle member 260, shown separately in FIG. 14 and including a seat 262 formed in a modified and curved V-shape, and an externally threaded shaft 261 extending slidably through the central through bore 221 in the central section 223 of the yoke 222. The seat 262 of the saddle member 260 is attached to the proximal end of the stem 261, and is provided for placement contacting a portion of a musical instrument's neck 12 opposite the fretboard 14. The proximal end of the central stem is fixedly and non-rotatably attached to a central portion of the seat 262, to permit axial adjustment of the seat in relation to the yoke 222.

Figure 9A:
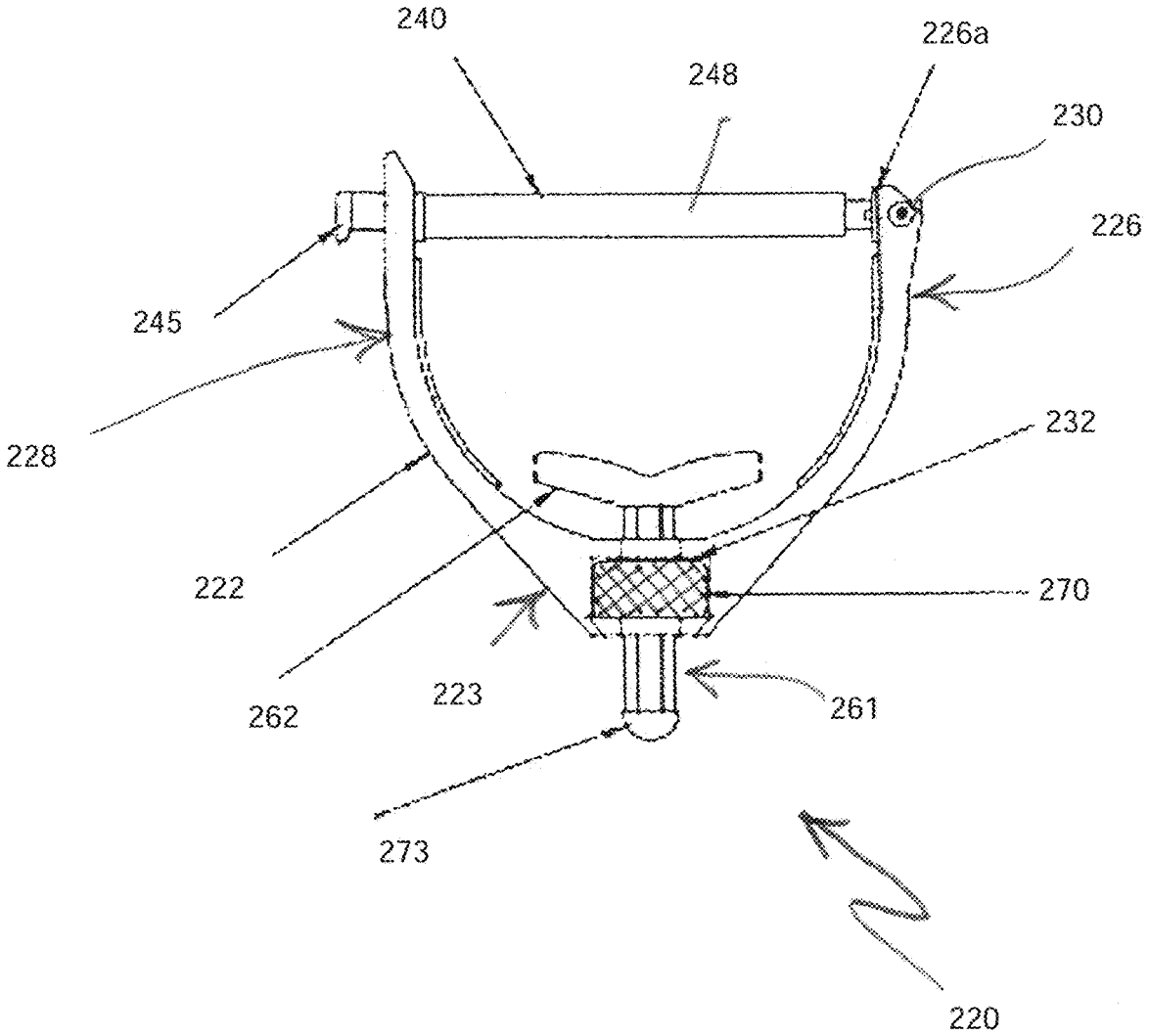
FIG. 9A is a front plan view of a capo according to a second embodiment hereof, shown in a closed configuration.
Figure 9B:
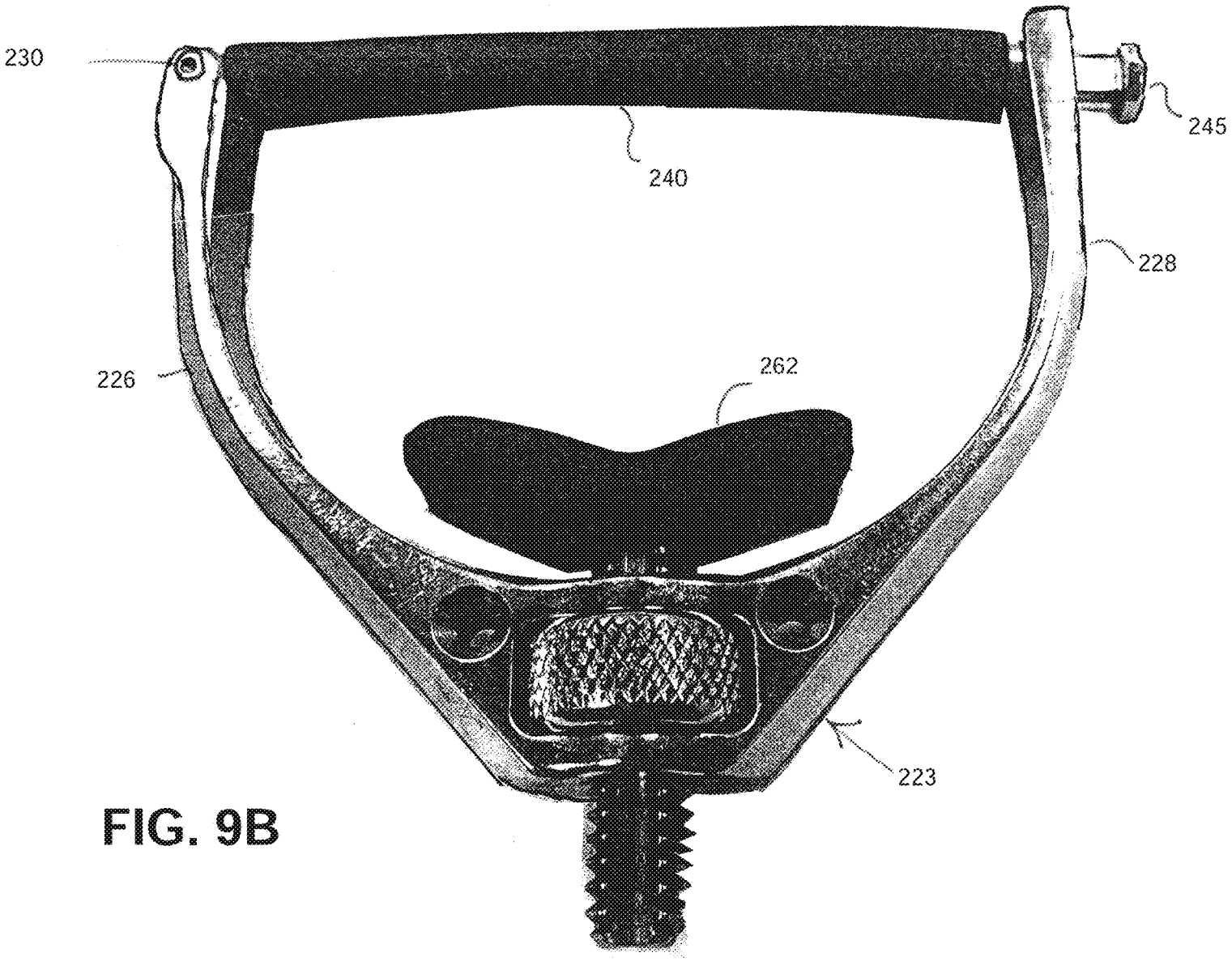
FIG. 9B is a rear perspective view of the capo according to the second embodiment.
Figure 10B:
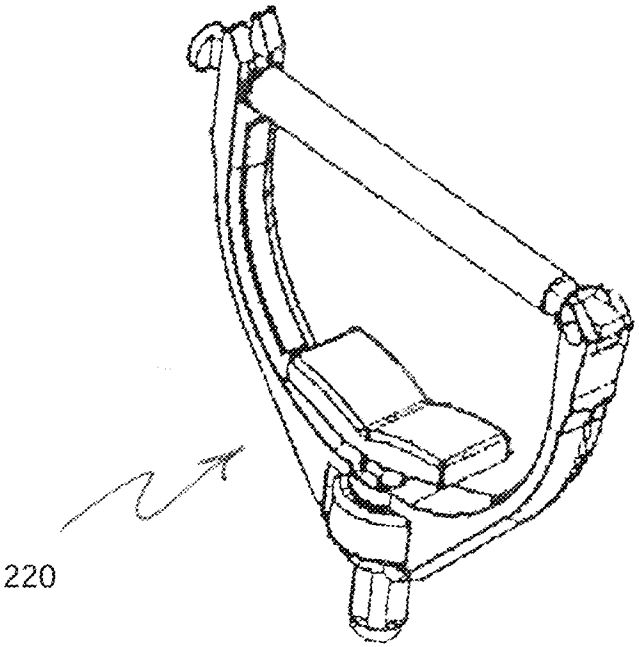
FIG. 10B is a second three-quarter perspective view of the capo according to the second embodiment.
Figure 10A:
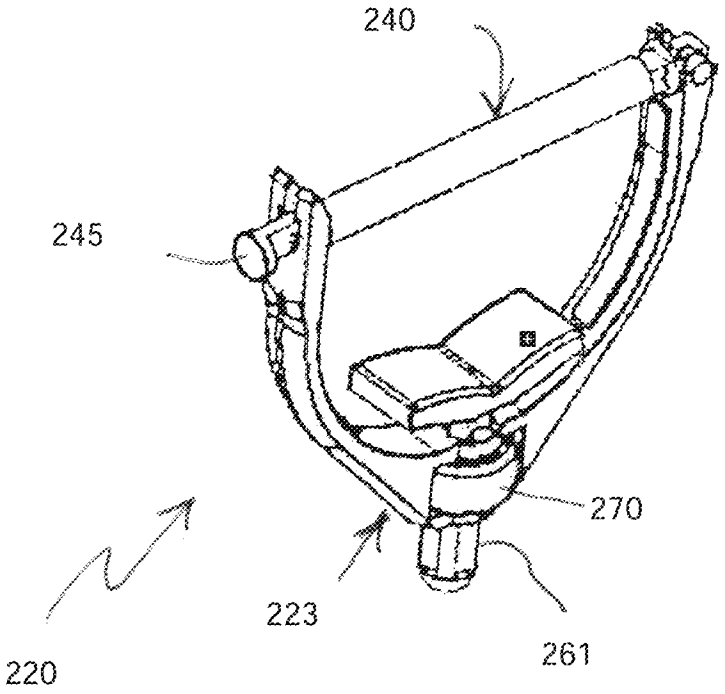
FIG. 10A is a first three-quarter perspective view of the capo according to the second embodiment.
Figure 11B:
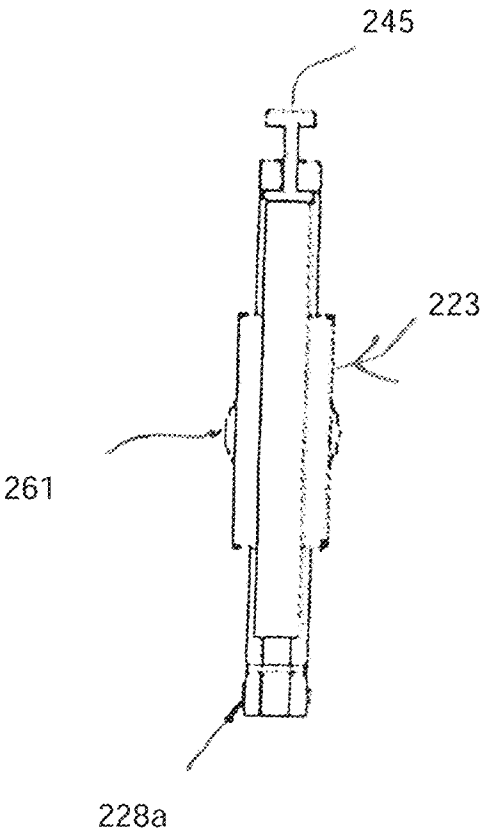
FIG. 11B is a top plan view of the capo according to the second embodiment.
Figure 11A:
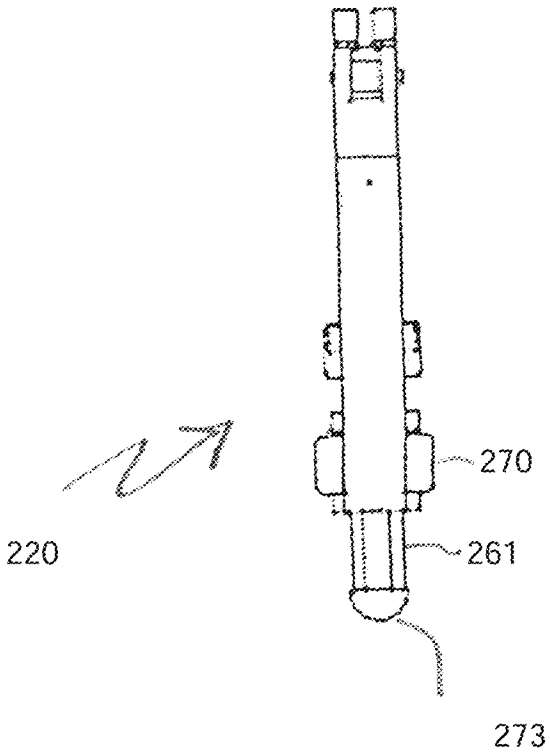
FIG. 11A is a side plan view of the capo according to the second embodiment.

In this second illustrative embodiment, the saddle member 260 is connected to the yoke 222 by its associated shaft 261 passing through the central through bore 221 of the yoke, and by the adjustment nut 270 disposed in the yoke's central portion 223. The shaft 261 of the saddle member 260 has a multi-lobed non-circular cross-sectional shape corresponding to the shape of the central through bore 221, and therefore, the saddle member is prevented from rotating about the axis A in relation to the yoke 222. The outer edges of the lobe portions of the shaft 261 have male threads formed thereon, as shown in FIGS. 9B and 12.

Figure 18:
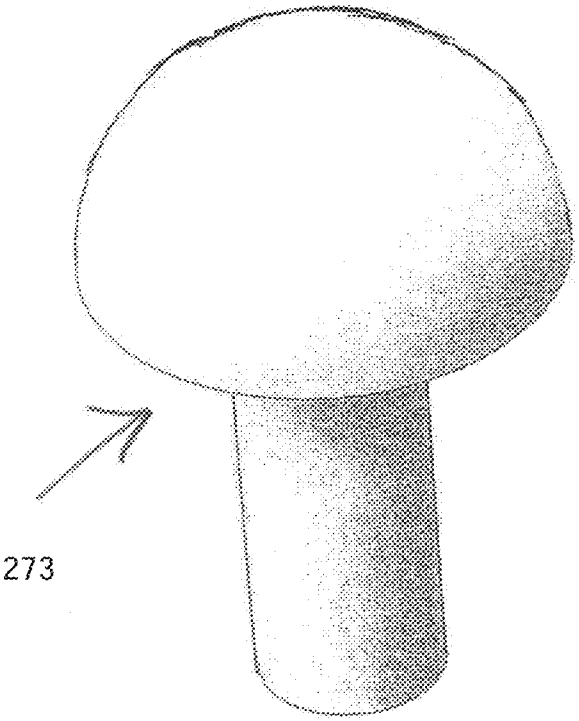
FIG. 18 is a perspective view of a mushroom-shaped end piece which is an optional component part of the capo according to the second embodiment hereof.

FIG. 18 is a perspective view of a mushroom-shaped end piece 273 which is an optional component part of the capo 220 according to the second embodiment hereof. Where used, this end piece 273 is attached to the distal end of the shaft 261 of the saddle member 260, as shown in FIG. 9A.

Figure 19:
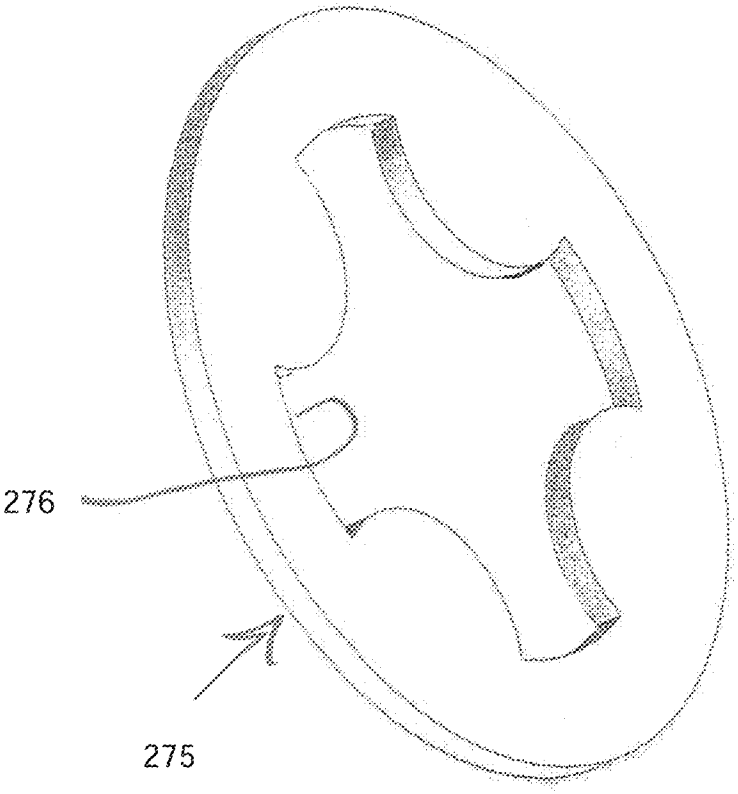
FIG. 19 is a perspective view of a plastic thrust washer which is another, optional component part of the capo according to the second embodiment hereof.

FIG. 19 is a perspective view of a plastic thrust washer 275 which is another, optional component part of the capo 220 according to the second embodiment hereof. The opening 276 inside of the washer 275 conforms to the cross-sectional shape of the central through bore 221 formed in the central section 223 of the yoke, in order to permit the washer to fit on the shaft 261 of the saddle member 260.

Figure 15:
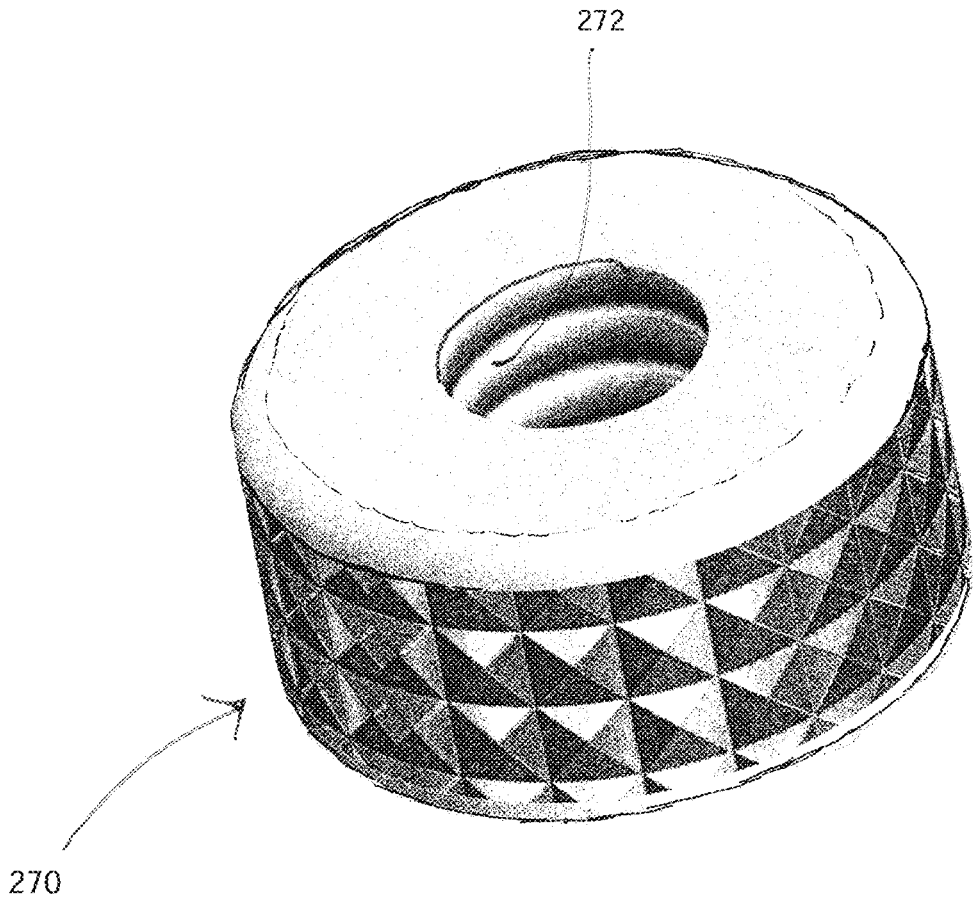
FIG. 15 is a perspective view of an adjustment nut which is another component part of the capo according to the second embodiment hereof.

As previously noted, the adjustment nut 270 fits inside of the rectangular passage 232 formed in the central portion 223 of the yoke 222. Optionally, a first plastic washer 275 may be placed above the adjustment nut 270 inside of the rectangular passage 232, and a second plastic washer 275 may be placed below the adjustment nut 270 inside of the rectangular passage 232. The adjustment nut 270 is shown separately in FIG. 15. The adjustment nut 270 may have a knurled or otherwise textured outer cylindrical contact surface, as shown. The adjustment nut 270 has female threads 272 formed internally therein, which are configured to threadably engage the male threads formed on the outside of the shaft 261 of the saddle member 260. Manual rotation of the adjustment nut 270 causes the saddle member 260 to move along the central axis A, toward or away from the yoke 222, and also toward or away from the clamping bar 240 in its closed position. In use on a musical instrument, this becomes a movement of the saddle member 260 toward the neck to tighten the capo in position, or away from the neck to loosen the capo from the neck.

Figure 16:
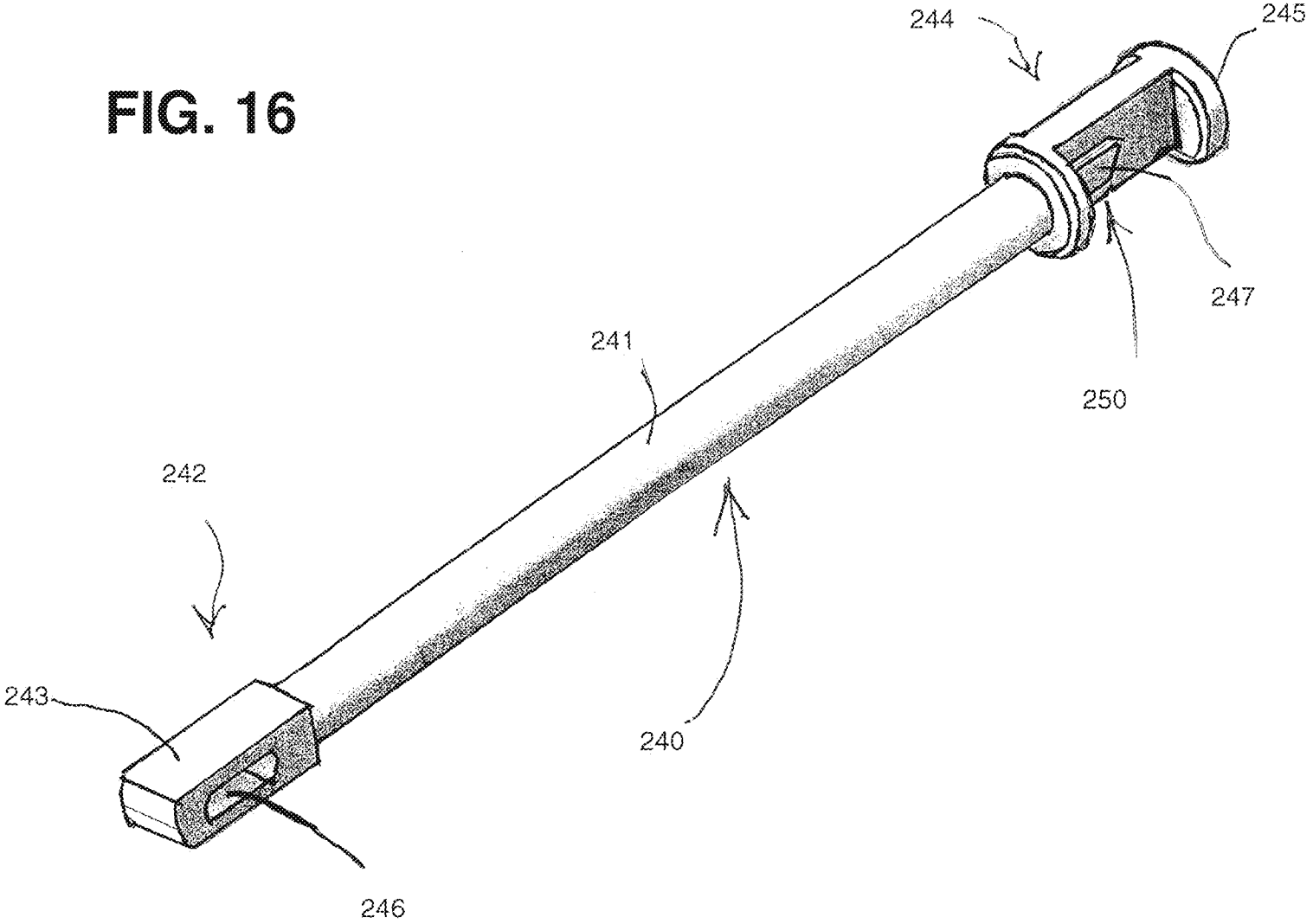
FIG. 16 is a perspective view of a clamping bar which is another component part of the capo according to the second embodiment hereof.
Figure 17:
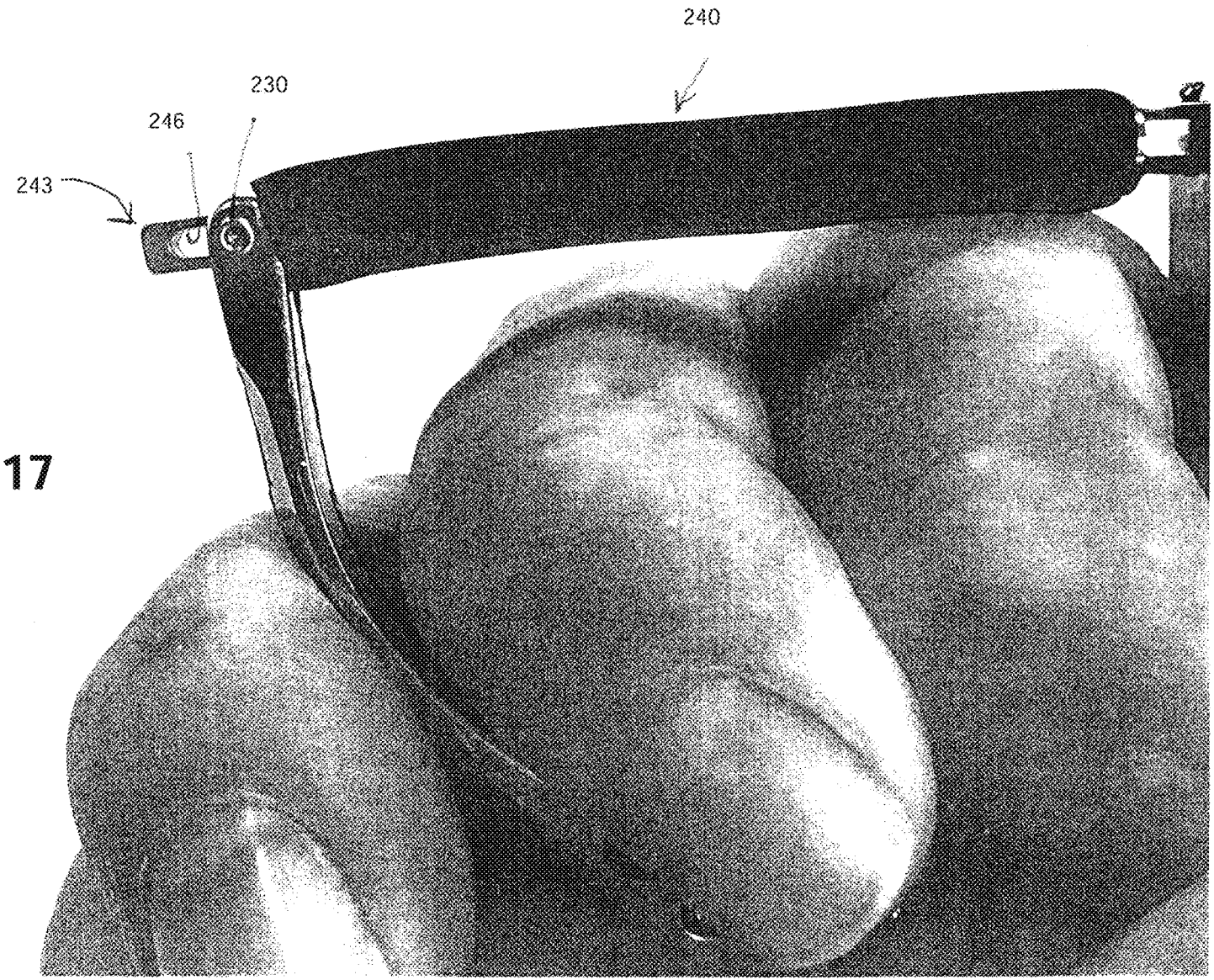
FIG. 17 is a detail perspective view of the capo of FIGS. 9A-9B, showing a tip end of the clamping bar in a compressed configuration during application of pressure to the opposite end of the clamping bar.

The capo 220 also includes a pivotally movable and padded clamping bar 240, which is pivotally connected to the first branch portion 226 of the yoke 222 via the fastener 230, in a manner to be described further below. The clamping bar 240 is shown separately in FIG. 16, and has a first end 242 and a second end 244. As seen in FIG. 16, the first end 242 of the clamping bar 240 ends in a tip portion 243 with a thickened plate shape, configured to fit in the bar-receiving slot 225 (FIG. 13) of the yoke's first branch portion 228. The tip portion 243 of the clamping bar 240 has a longitudinal slot 246 formed therein which receives a shaft portion of the fastener 230 therethrough, and in this way, the clamping bar 240 is pivotally attached to the first branch end 226*a* of the yoke 222. The fastener 230 may alternatively be referred to as a retainer, and may be a rivet, a threaded fastener, or other retaining member. The fastener 230 includes a cylindrical shaft portion similar to that shown at 30*s* in FIG. 3, which is inserted through the longitudinal slot 246 of the tip portion 243 at the first end of the clamping bar 240, in a manner such that the clamping bar is selectively pivotally movable around the shaft portion of the fastener 230.

As seen in FIG. 16, the second end 244 of the clamping bar 40 includes a manually pres sable terminal portion 245, and an engaging portion 250 proximate the terminal portion, the engaging portion being selectively operatively engagable with the machined notch 229 formed in the free branch end 228*a* of the second branch portion 228, for temporarily and releasably locking the second end 244 of the clamping bar 240 into engagement with the free branch end 228*a*. In the depicted embodiment, the engaging portion 250 includes at least one integral outwardly extending boss 247. This boss 247 is configured to fit engagingly into the widened portion of the machined notch 229 formed in the free branch end 228*a* of the yoke 222.

The capo 220 according to the second illustrative example hereof further includes a tubular biasing member 248, formed of flexibly resilient material such as flexible plastic, rubber, or an elastomer. The tubular biasing member 248 may be transparent or opaque, as desired. This tubular biasing member 248 surrounds a main body portion 241 of the clamping bar 240, between the two ends 242, 244 thereof;

In addition, the clamping bar 240 is slidably movable in a longitudinal direction thereof, in relation to the yoke 222, by a short distance corresponding to the length of the slot 246 formed in the tip portion 243 of the clamping bar.

This movement of the clamping bar 240 also slidably moves the engaging portion 250 of the clamping bar out of engagement with the machined notch 229 of the yoke. At the same time, such manual pressure on the terminal portion of the clamping bar compresses the tubular biasing member 248, permitting a user to then pivotally move the second end 244 of the clamping bar away from the free branch end 228*a* of the yoke 222.

A similar process to that described above may be used in reverse to engage the engaging portion 250 of the clamping bar 240 in the machined notch 229 of the yoke 222. When manual pressure on the terminal end 245 of the clamping bar 240 is released, the resilient nature of the tubular biasing member 248 moves the boss 247 on the engaging portion 250 into the widened portion of the yoke's machined notch 229, thereby temporarily locking the position of the clamping bar 240 in relation to the yoke 222.

Third Embodiment

Figure 20:
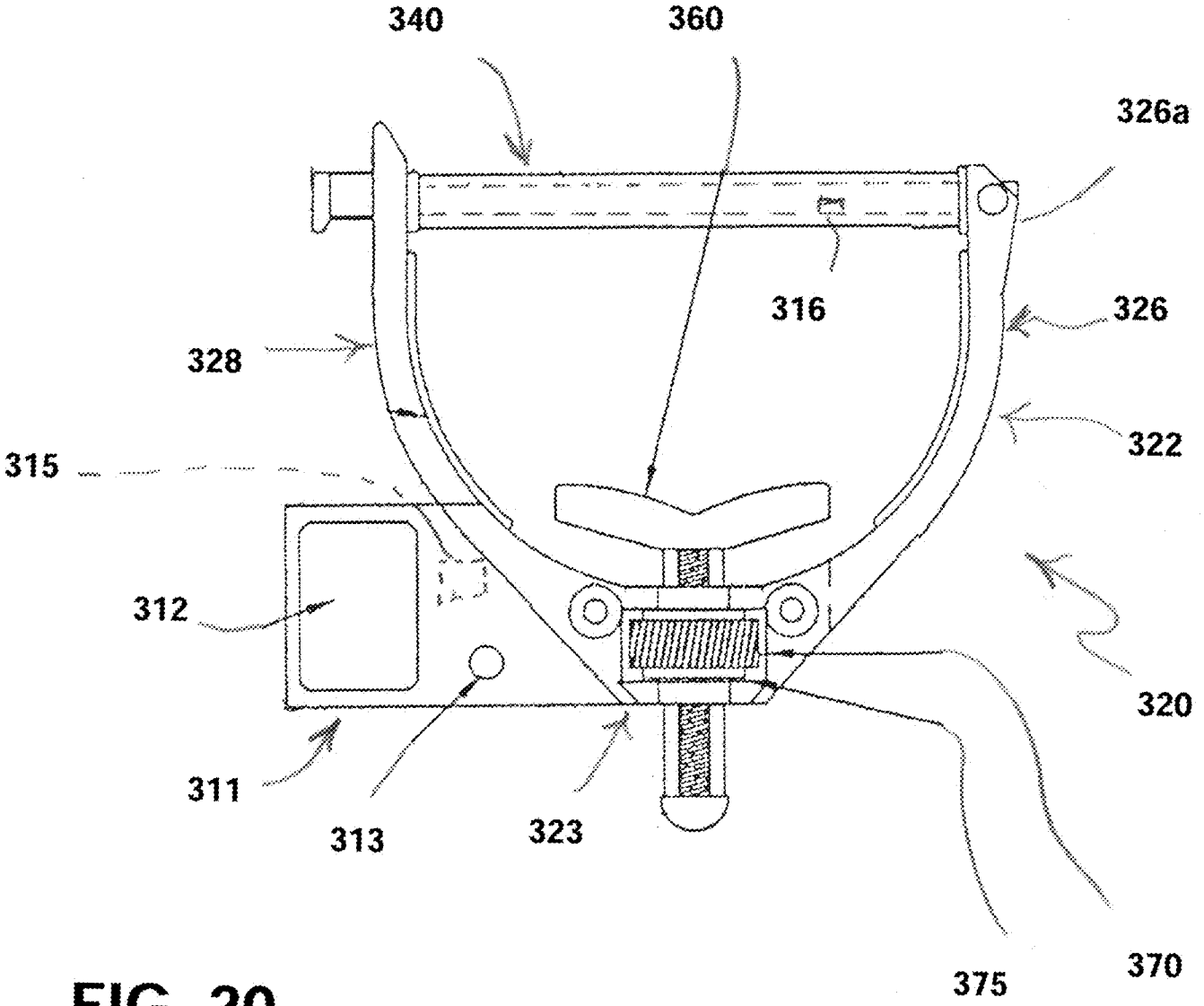
FIG. 20 is a front plan view of a capo according to a third embodiment.
Figure 21:
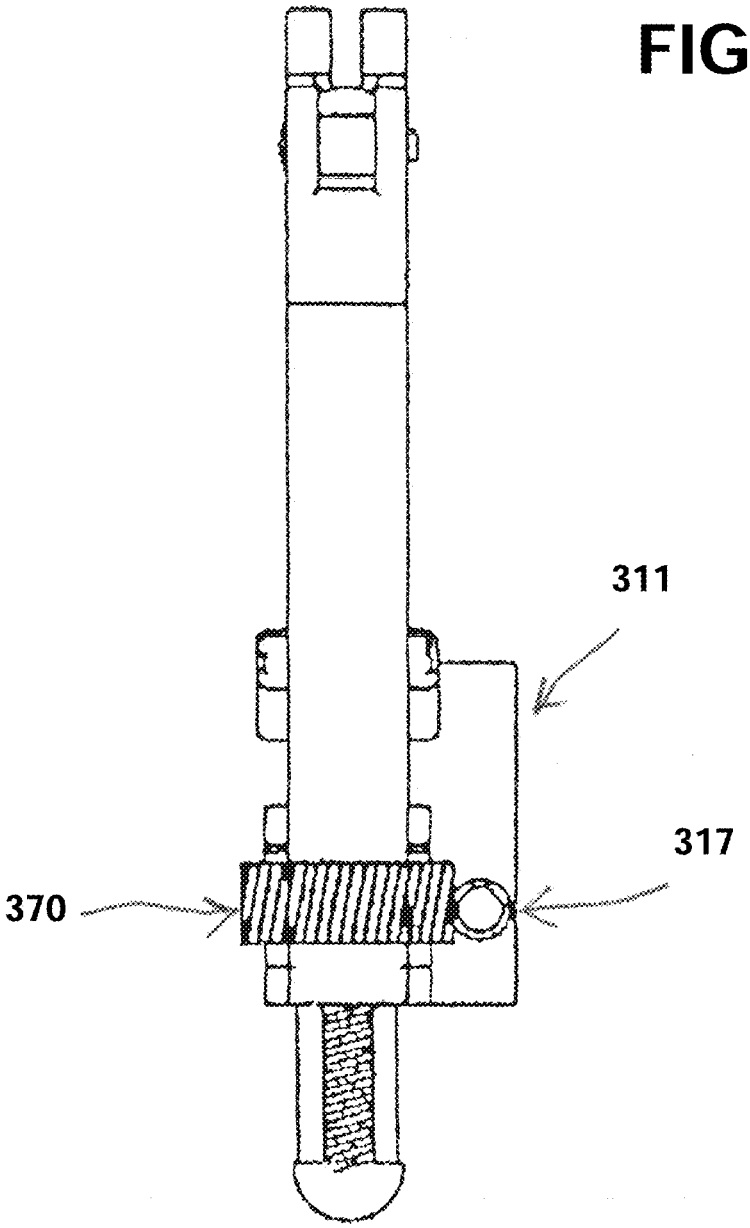
FIG. 21 is a side plan view of the capo according to the third embodiment.
Figure 22:
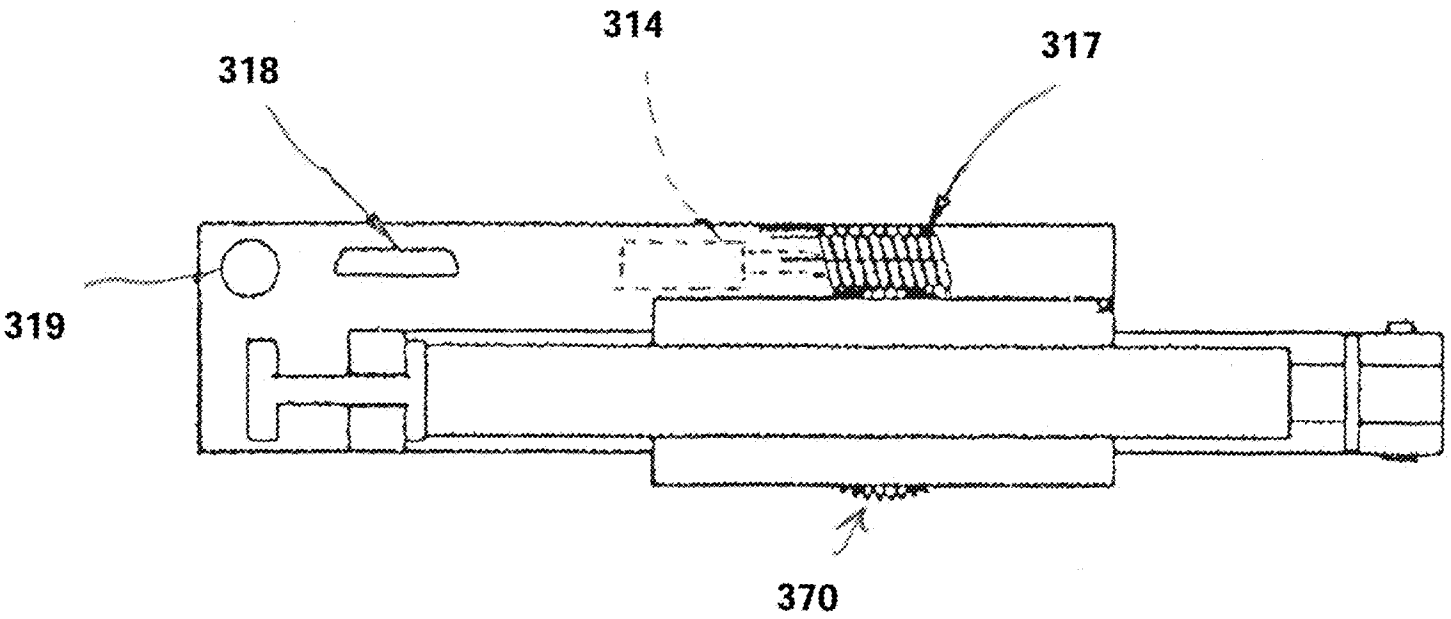
FIG. 22 is a top plan view of the capo according to the third embodiment.

FIGS. 20-22 illustrate a capo 320 according to a third embodiment of the invention.

The capo 320 according to the third embodiment is substantially identical to the capo according to the second embodiment, except as otherwise described herein, with some additional features which are not present in the second embodiment. In a manner similar to the capo 220 according to the second embodiment, the capo 320 includes a yoke 322, a saddle member 360 adjustably attached to the yoke, and a clamping bar 340 pivotally attached to a first branch end 326*a* of the yoke.

The yoke 322 includes a central section 323 and first and second branch portions 326, 328 integrally attached to, and extending outwardly from the central section 323 in opposite directions.

In the capo 320 according to this third embodiment, a control module 311 is attached to the yoke 322, as shown. The control module 311 includes a touch screen 312 with visual display, a power switch 313, a motor 314, and a microprocessor 315 in electronic communication with the motor 314 and also with a pressure sensor 316 situated on the clamping bar 340. The touch screen 312 may be about the size of a smartwatch screen, and may use commercially available smartwatch components.

The capo 320 according to the third embodiment also includes a cylindrical adjustment nut 370 having external teeth thereon. The cylindrical adjustment nut 370 also functions as a ring gear which can be driven by the motor 314 via a worm gear 317. Optionally, a thrust washer 375 may be placed below the adjustment nut 370.

The control module 311 may be controlled through a smart phone and an application program by Bluetooth, other wireless connection methods, or from a separate device with a touch screen that could be clipped onto a guitar strap.

The control module 311 uses the smallest, most powerful battery available to power the motor 314, microprocessor 315 and other components.

The control module 311 may be charged at a charging port 318 using a conventional, commercially available cable. Optionally, a headphone jack 319 may be provided on the control module 311.

The control module 311 is capable of to downloading application programs, such as tuners, metronomes, music, tabs, and other music-related programs.

The capo 320 may be provided with screw position presets for specified pressures of the clamping bar 340 on a fretboard of a musical instrument, and may also be provided with a torque or pressure limit, which works in conjunction with the pressure sensor 316. For example, the capo 320 could be preset to shut down when the torque is applying 5 lbs. of pressure.

Other optional features which could be provided as components of the control module 311 include a humidity meter), and/or an attachment (bit) string winder (not shown) that clicks into the topside of the gear-motor 314. This string winder, where used, could be in sync with the onboard tuner app. and control the movement to stop winding when a string is in tune.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the appended claims, are intended to be within the scope and spirit of the present invention.

I claim:

1. A capo for use with a stringed musical instrument having a neck including a fretboard and a plurality of strings extending parallel to one another above the fretboard, the capo comprising:

a substantially U-shaped yoke having a yoke body with a center section having a central through bore formed therein and defining a first axis, the yoke body having a first yoke branch extending outwardly on a first side of the center section and a second yoke branch extending outwardly on a second side of the center section, the first yoke branch having a retaining shaft thereon;

a clamping bar having a longitudinal axis and being operatively connected to the first yoke branch, the clamping bar comprising a free end provided with an engaging boss which fits into a machined notch of the second yoke branch, the clamping bar being selectively pivotally movable around the retaining shaft, the clamping bar also including a tip portion disposed opposite the free end and having a longitudinally-extending slot formed therein, the clamping bar being slidably movable, relative to the yoke, by a length of the slot formed therein;

a saddle member comprising a central stem extending through the central through bore of the yoke, a seat attached to the stem, and an adjustment member for tightening the saddle member in relation to the yoke; and a resilient, tubular biasing member surrounding a main body of the clamping bar;

wherein the capo is configured and arranged such that pressing the free end of the clamping bar inwardly in a direction along the longitudinal axis of the clamping bar compresses the biasing member, and slides the engaging portion of the clamping bar out of the machined notch of the yoke, to allow pivotal movement of the clamping bar in relation to the yoke.

2. The capo of claim 1, wherein the adjustment member comprises a thumbscrew integrally attached to the distal end of the central stem for selectively causing rotation thereof.

3. The capo of claim 1, wherein the free end of the clamping bar comprises a terminal portion which is oriented substantially perpendicular to the longitudinal axis of the clamping bar.

4. The capo of claim 1, wherein the engaging portion of the clamping bar includes two bosses extending outwardly on opposite sides of the clamping bar.

5. A capo for use with a stringed musical instrument having a neck including a fretboard and a plurality of strings extending parallel to one another above the fretboard, said capo comprising:

a substantially U-shaped yoke, said yoke comprising:

a yoke body with a center section having a central through bore formed substantially centrally therethrough and defining a first axis, said yoke body having a first yoke branch extending outwardly on one side of said center section and a second yoke branch extending outwardly on the other side of said center section, said first yoke branch terminating at a first branch end having a bar-receiving slot formed therein, said second yoke branch terminating at a free branch end having a machined notch formed therein configured to temporarily receive one end of a clamping bar;

a clamping bar having a first bar end and a second bar end, said first bar end of said clamping bar ending in a tip portion with a plate shape having rounded corners and configured to fit in the bar-receiving slot of the first yoke branch, the tip portion of the clamping bar having a longitudinal slot formed therein and being pivotally attached to said first branch end of the yoke, said second bar end of said clamping bar having a manually pressable terminal portion and an engaging portion proximate the terminal portion, the engaging portion being selectively operatively engagable with the machined notch of the second yoke branch for temporarily and releasably locking said second end of the clamping bar into engagement with said free branch end of the yoke;

a retaining shaft operatively attached to the first branch end of the first yoke branch, the retaining shaft extending through the longitudinal slot of the tip portion at the first bar end of the clamping bar, whereby the clamping bar is selectively pivotally movable, in relation to the first end of the yoke, around the retaining shaft, and the clamping bar is also slidably movable by a distance corresponding to the length of the slot formed in the tip portion of the clamping bar;

a saddle member comprising a central stem having a proximal end and a distal end, the central stem extending through the central through bore of the yoke body and having male threads formed thereon;

a seat portion attached to the proximal end of said stem for placement contacting a portion of said neck opposite said fretboard; and an adjustment member, operatively associated with the central stem, for selectively adjusting a position of the saddle member in relation to the yoke;

a tubular biasing member formed of flexibly resilient material and surrounding a main body portion of the clamping bar between the two ends thereof;

wherein the capo is configured such that manually pressing on the terminal portion of the clamping bar compresses the biasing member and slidably moves the engaging portion of the clamping bar out of engagement with the machined notch of the yoke, permitting a user to pivotally move the second end of the clamping bar away from the free branch end of the yoke.

6. A capo for use with a stringed musical instrument having a neck including a fretboard and a plurality of strings extending parallel to one another above said fretboard, said capo comprising:

a substantially U-shaped yoke, said yoke comprising:

a yoke body having a core portion with a central through bore formed substantially centrally therethrough and defining a first axis, said central through bore having a non-circular cross section including a plurality of lobes, said yoke body having a first branch extending outwardly on one side of said core portion, and a second branch extending outwardly on the other side of said core portion, said core portion further having a passage formed therethrough in a direction substantially perpendicular to said first axis, said passage having a substantially rectangular cross-sectional shape;

said first branch terminating at a first branch end having a hollow bore formed therein for receiving a fastener and having a bar-receiving slot formed therein which intersects said hollow bore, said second branch terminating at a free branch end having a machined notch formed therein configured to temporarily receive one end of a clamping bar;

a saddle member comprising a central stem having a proximal end and a distal end, the central stem having a non-circular cross-section with a plurality of lobes, distal ends of the lobes having male thread portions formed thereon, and a seat portion attached to the proximal end of said stem for placement contacting a portion of said neck opposite said fretboard, wherein the central stem is rotatably attached to a central portion of the seat portion;

a knurled nut disposed in the passage of the yoke body, the nut surrounding a portion of the central stem of the saddle member and provided for selectively adjusting a position of the saddle member relative to the yoke, a clamping bar having a first bar end and a second bar end, said first end of said clamping bar ending in a tip portion with a plate shape having rounded corners and configured to fit in the bar-receiving slot of the first branch, the tip portion of the clamping bar having a longitudinal slot formed therein and being pivotally attached to said first branch end, said second end of said clamping bar having a manually pressable terminal portion and an engaging portion proximate the terminal portion, the engaging portion being selectively operatively engagable with the machined notch of the second branch for temporarily and releasably locking said second end of the clamping bar into engagement with said free branch end;

a fastener which fits into the hollow bore of the first branch and having a shaft portion which is inserted through the longitudinal slot of the tip portion at the first end of the clamping bar, whereby the clamping bar is selectively pivotally movable around the shaft portion of the fastener, and is slidably movable by a distance corresponding to the length of the slot formed in the tip portion of the clamping bar, in relation to the first end of the yoke;

a tubular biasing member formed of flexibly resilient material and surrounding a main body portion of the clamping bar between the two ends thereof;

wherein manually pressing on the terminal portion of the clamping bar slidably moves the engaging portion of the clamping bar out of engagement with the machined notch of the yoke and compresses the biasing member, permitting a user to pivotally move the clamping bar to move the second end thereof away from the free branch end of the yoke.

7. The capo of claim 5, wherein the terminal portion of the clamping par is substantially perpendicular to a longitudinal axis of the clamping bar.

8. The capo of claim 5, wherein the engaging portion of the clamping bar includes two bosses extending outwardly on opposite sides of the clamping bar.

9. The capo of claim 6, wherein the engaging portion of the clamping bar includes two bosses extending outwardly on opposite sides of the clamping bar.

* * * * *